US011396740B2

(12) United States Patent
Thogersen et al.

(10) Patent No.: US 11,396,740 B2
(45) Date of Patent: Jul. 26, 2022

(54) INDEPENDENT CONTROL FREE STANDING BATH FILLER

(71) Applicant: Kohler Co., Kohler, WI (US)

(72) Inventors: Austen G. Thogersen, Sheboygan, WI (US); Jeffrey A. Schumacher, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/739,251

(22) Filed: Jan. 10, 2020

(65) Prior Publication Data

US 2020/0232197 A1 Jul. 23, 2020

Related U.S. Application Data

(60) Provisional application No. 62/794,087, filed on Jan. 18, 2019.

(51) Int. Cl.
*E03C 1/04* (2006.01)

(52) U.S. Cl.
CPC ..... *E03C 1/0404* (2013.01); *Y10T 137/9464* (2015.04)

(58) Field of Classification Search
None
See application file for complete search history.

(56) References Cited

U.S. PATENT DOCUMENTS 4,227,548 A 10/1980 Botnick
4,739,798 A 4/1988 Botnick
5,185,893 A * 2/1993 Lin ..... E03C 1/023 137/597
6,644,333 B2 11/2003 Gloodt
8,109,292 B2 2/2012 Bolgar et al.
8,613,293 B2 12/2013 Bolgar et al.
9,194,110 B2 11/2015 Frick et al.
9,464,416 B1 10/2016 Breda
9,581,255 B2 2/2017 Zieger et al.
9,816,634 B2 11/2017 Wawrla et al.
(Continued)

FOREIGN PATENT DOCUMENTS

CN 104652545 A * 5/2015
CN 106439114 A 2/2017
(Continued)

OTHER PUBLICATIONS

CN104652545A, Gao, Machine Translation (Year: 2015).*
(Continued)

*Primary Examiner* — Daphne M Barry
(74) *Attorney, Agent, or Firm* — Foley & Lardner LLP

(57) ABSTRACT

A free standing bath filler that includes a body having an inlet configured to receive hot and cold water, a first outlet, and a second outlet; a first valve located within the body and configured to control at least one of a flow rate or a temperature of water from the inlet to the first outlet; a second valve located within the body and configured to control at least one of a flow rate or a temperature of water from the inlet to the second outlet; a first controller configured to control an operation of the first valve; and a second controller configured to control an operation of the second valve, wherein the each controller is operable independently of the other controller.

19 Claims, 17 Drawing Sheets

(56) References Cited

U.S. PATENT DOCUMENTS

2015/0219225 A1* 8/2015 Zieger ..... B05B 1/1645
137/625.41
2016/0341325 A1 11/2016 Ye et al.

FOREIGN PATENT DOCUMENTS

DE 4140433 A1 * 6/1993 ..... E03C 1/04
EP 2990703 A1 * 3/2016 ..... F16K 35/025

OTHER PUBLICATIONS

DE4140433A1, Gottwald, Machine Translation (Year: 1993).*
CN First Office Action on Chinese Patent Application No. 202010053844.8 dated Sep. 3, 2021.

* cited by examiner

INDEPENDENT CONTROL FREE STANDING BATH FILLER

CROSS-REFERENCE TO RELATED PATENT APPLICATIONS

This application claims priority to and the benefit of U.S. Provisional Application No. 62/794,087, filed on Jan. 18, 2019, and incorporated herein by reference in its entirety.

BACKGROUND

The present disclosure relates generally to the field of bath and tub fillers. More specifically, this disclosure relates to a free standing bath/tub filler having two separate valves, each of which is independently adjustable to control temperature and flow rate of water to one of two separate outlets.

SUMMARY

At least one embodiment of the application relates to a free standing bath filler having a body having an inlet configured to receive hot and cold water, a first outlet, and a second outlet; a first valve located within the body and configured to control at least one of a flow rate or a temperature of water from the inlet to the first outlet; a second valve located within the body and configured to control at least one of a flow rate or a temperature of water from the inlet to the second outlet; a first controller configured to control an operation of the first valve; and a second controller configured to control an operation of the second valve, wherein the each controller is operable independently of the other controller At least one embodiment of the application relates to a free standing bath filler having a body and first and second valves. The body includes an inlet configured to receive hot and cold water, a first stem fluidly connecting the inlet to a first outlet, and a second stem coupled to the first stem and fluidly connecting the inlet to a second outlet. The first valve is located within the first stem and configured to control at least one of a flow rate or a temperature of water from the inlet to the first outlet. The second valve is located within the second stem and configured to control at least one of a flow rate or a temperature of water from the inlet to the second outlet. Each valve is operable independently of the other valve.

At least one embodiment of the application relates to a free standing bath filler having a body extending between first and second ends, the first end including an inlet configured to receive hot and cold water; a spout extending from the body and having a first outlet; and a stem extending from the body and having a second outlet; a first valve located within the body and configured to control a flow rate and a temperature of water from the inlet to the first outlet; and a second valve located within the stem and configured to control a flow rate and a temperature of water from the inlet to the second outlet, wherein the each valve is operable independently of the other valve.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, disclosed herein are free standing bath/tub fillers (e.g., spouts, faucets, etc.) that include two separate (e.g., dual) valves, each of which is independently adjustable to control temperature and/or flow rate of water to one of two (e.g., dual) separate outlets. By way of example, a first outlet can be configured to fill a bath/tub for bathing and, therefore, a first valve associated with the first outlet can provide a relative high flow rate (e.g., up to around 17 gal/min) at a first temperature, while a second outlet can be fluidly connected to a hand shower and, therefore, a second valve associated with the second outlet can provide a relative low flow rate (e.g., up to around 2.5 gal/min) at a second temperature. Each valve can independently control temperature so that the two outlets can receive and supply water at two different temperatures. This arrangement is advantageous over bath fillers that include a single valve for controlling temperature and a diverter valve for directing flow between two outlets, because the latter design lacks independent temperature and flow rate control for two outputs, can provide only flow through a single outlet at any one time, and often diversion of the water occurs through tortuous routes leading to a significant reduction in flow rate (e.g., a drop from around 17 gal/min to around 8 gal/min), thereby increasing the time to fill the bath/tub.

Figure 1:
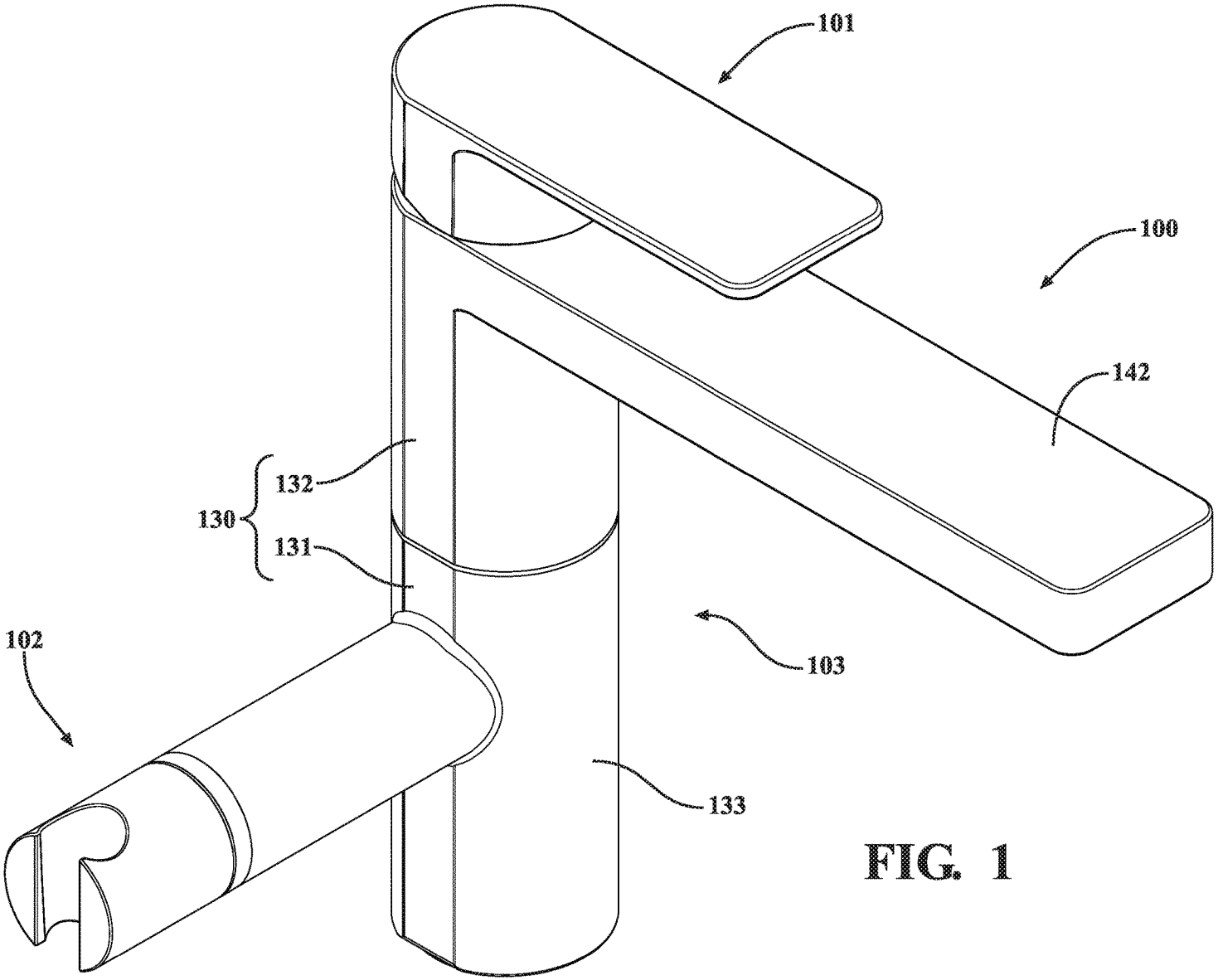
FIG. 1 is a perspective view of a bath filler, according to this application.

FIGS. 1-14 illustrate an example of a free standing bath filler 100 that is configured to mount to a mounting surface, which can be part of a bath/tub, a floor adjacent to the bath/tub, or other suitable supporting surface. As shown in FIG. 1, the bath filler 100 that includes first and second handles 101, 102 operably mounted on a body 103. The first handle 101 is configured to control temperature and/or flow rate of water to a first outlet (e.g., spout outlet) of the bath filler 100, and the second handle is configured to control temperature and/or flow rate of water to a second outlet (e.g., hand shower outlet) of the bath filler 100.

Figure 2:
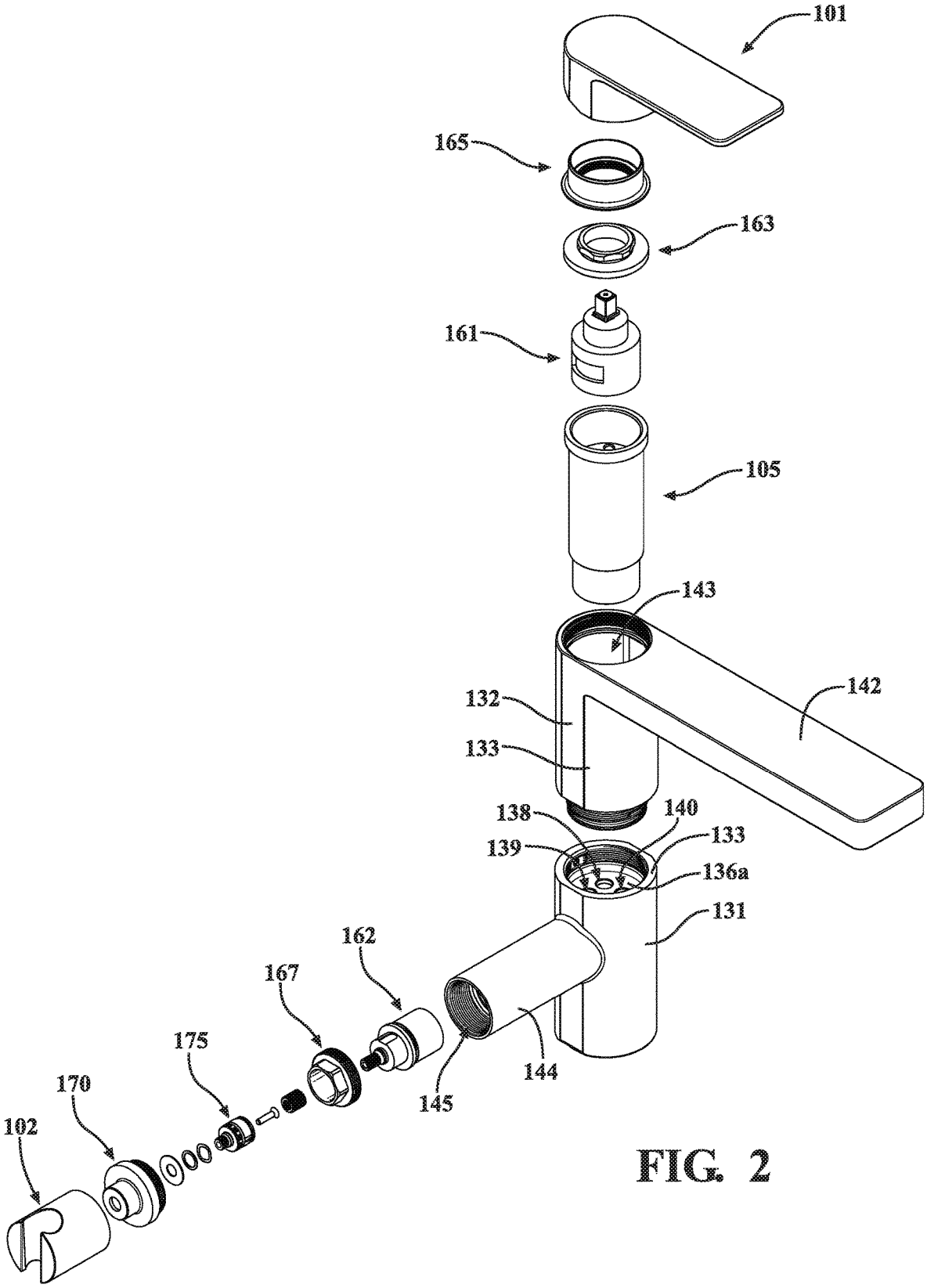
FIG. 2 is an exploded perspective view of the bath filler shown in FIG. 1.
Figure 3:
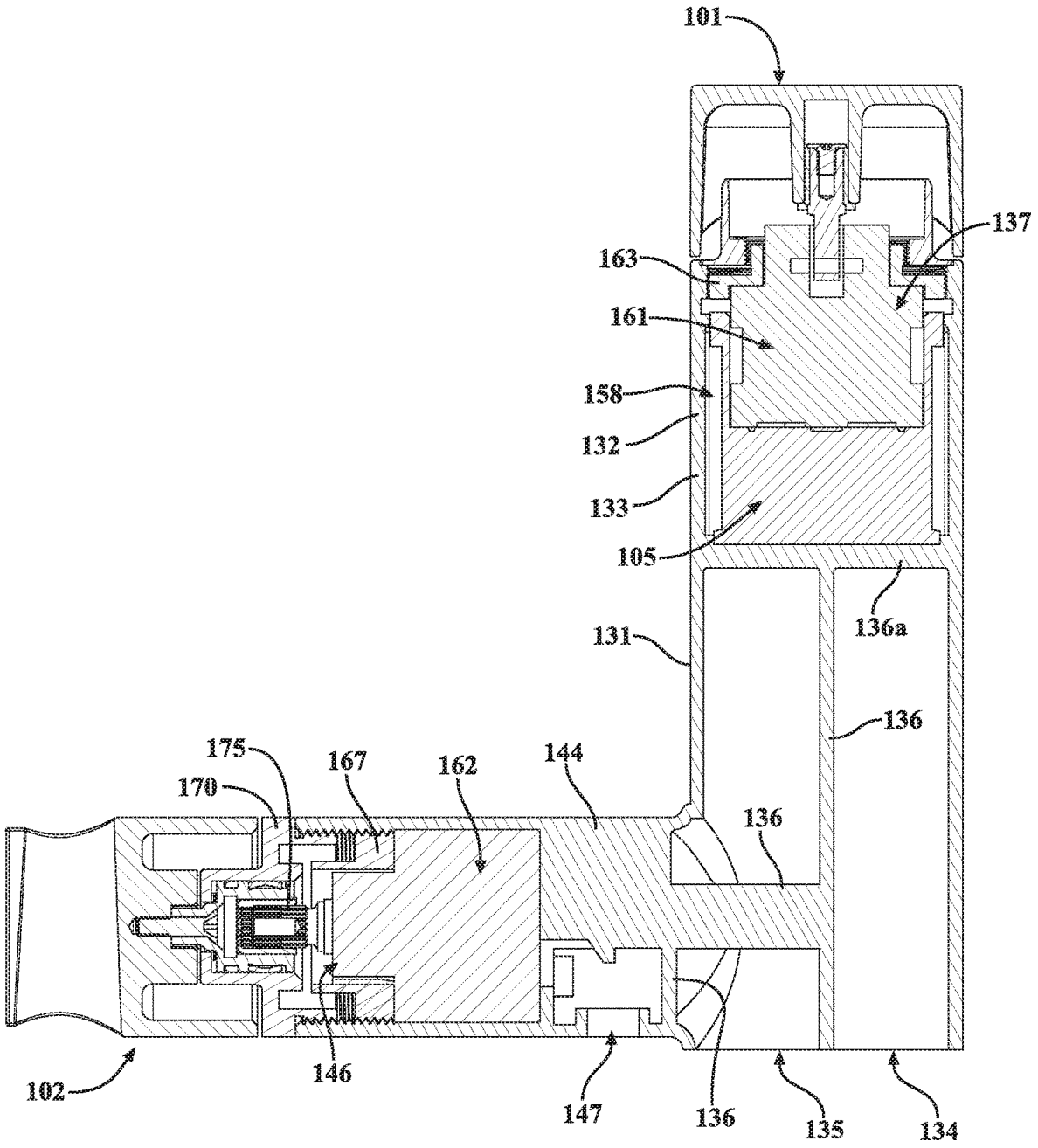
FIG. 3 is a side cross-sectional view of the bath filler shown in FIG. 1.

The body 103 can be a unitary (e.g., single or one piece or part) design, in which all of the elements of the body 103 are integrally formed together, or a multipart (e.g., multipiece) design, in which the body is formed of two or more separate parts or pieces then coupled together to form the body 103. FIGS. 1 and 2 illustrate a body 103 as a multipart design. FIG. 3 illustrates the body 103 as a unitary design. As shown in FIGS. 1-3 and 12, the body 103 includes a base stem 130 (e.g., vertical stem), which is defined by a first portion 131 (e.g., first part, lower part, lower portion, etc.) and a second portion 132 (e.g., second part, upper part, upper portion, etc.). Together, the first and second portions 131, 132 define a generally cylindrical outer wall 133 extending between first (e.g., lower) and second (e.g., upper) ends of the base stem 130. For the multipart designs, the various portions can be coupled together using mechanical fastening techniques (e.g., screws, bolts, rivets, etc.) or utilize other techniques. As shown in FIG. 2, a post extending from a bottom of the second portion 132 includes external threads that thread to internal threads in the outer wall 133 of the first portion 131 to couple the two portions 131, 132 together.

A lower end of the base stem 130 (e.g., a bottom of the first portion 131) defines an inlet for receiving hot and cold water, such as through hot and cold supply lines (not shown in FIGS. 1-3). As shown in FIG. 3, first and second inlets 134, 135 are disposed in lower end of the base stem 130 to receive cold and hot water, respectively. Thus, cold water enters into a cold water passage or chamber in the body 130 through the first inlet 134, and hot water enters into a hot water passage or chamber in the body 130 through the second inlet 135. One or more internal walls 136 separate (or divide) the body 103 into various internal fluid chambers or passages, such as cold and hot water chambers or passages in the body 103. One such internal wall is an upper lateral internal wall **136*a* (see FIGS. 3 and 12), which defines a cup 137 (e.g., first cup) with the outer wall 133 of the second portion 132. The cup 137 receives one of the two valves (e.g., a first valve, valve 161). The upper lateral internal wall 136*a* includes first and second openings 138, 139. The first opening 138 fluidly connects the valve to the cold water associated with the cold water chamber and the first inlet 134 (in the base stem 130), and the second opening 139 fluidly connects the valve to the hot water associated with the hot water chamber and the second inlet 135 (in the base stem 130). The upper lateral internal wall 136*a* can optionally include a third opening 140 (FIG. 2) to locate the position (e.g., rotational position) of a valve seat relative to the body 103** during assembly.

The body 103 also includes a spout 142 for directing water from an outlet of the valve 161 to an outlet in a distal end the spout 142, such that the water exits the bath filler 100 through an outlet in the spout 142. As shown in FIGS. 1 and 2, the spout 142 extends from an upper end of the second portion 132 of the base stem 130. Although the spout 142 is shown (e.g., in FIG. 12) as having a generally rectangular cuboidal shape, the spout can have any suitable shape (e.g., cylindrical, J-shaped, etc.). An opening 143 in the top of the base stem 130 and/or spout 142 provides access to the cup 137 that receives the first valve and the valve seat (FIG. 2).

Figure 12:
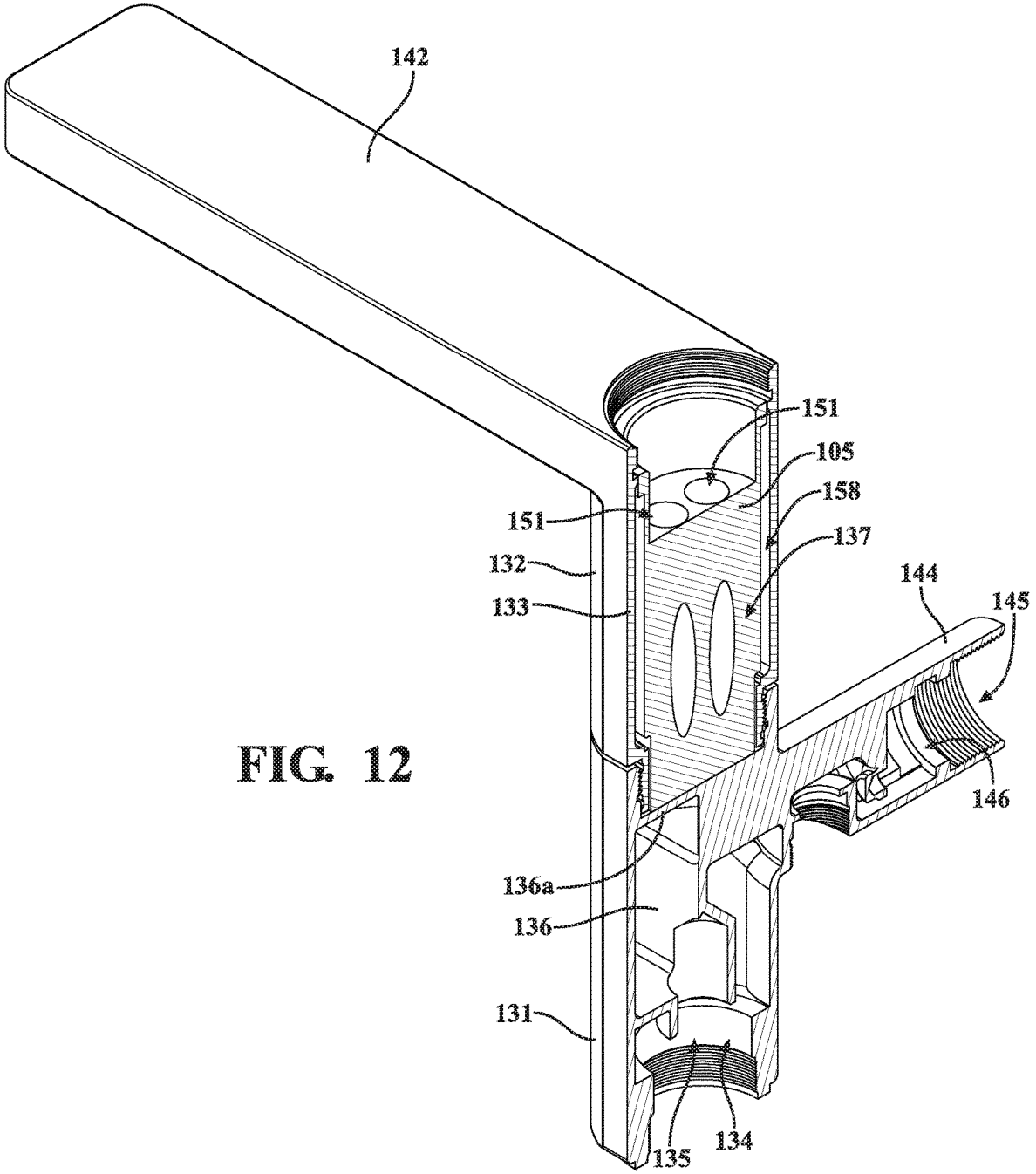
FIG. 12 is a perspective cross-sectional view of a portion of the bath filler shown in FIG. 1.

The body 103 also includes a lateral stem 144 extending from a side of the base stem 130. As shown in FIGS. 1, 2, and 12, the lateral stem 144 extends from a side of the first portion 131 of the base stem 130. Although the lateral stem 144 is shown as being generally cylindrical and extending generally orthogonally relative to the base stem 130 and the spout 142, the lateral stem 144 can have other shapes (e.g., rectangular cuboidal, etc.) and can extend in different directions (e.g., at an angle, at compound angles, curved, etc.) and/or from a different element relative to these elements, than the design shown. As shown in FIG. 2, an opening 145 in a distal end of the lateral stem 144 (i.e., the end opposite where the lateral stem 144 meets the base stem 130) defines a cup 146 (e.g., second cup), as shown in FIGS. 3 and 12, for receiving a valve (e.g., the second valve, valve 162). One or more internal walls 136 define an outlet 147 that is fluidly connected to an outlet of the second valve, such that water flowing through the second valve exits the body 103 through the outlet 147 in the lateral stem 144. The illustrated outlet 147 includes an outlet chamber and an opening in the lateral stem 144 that fluidly connect to the outlet of the valve 162.

It is noted that the illustrated body 103 is configurable as a unitary part, in which two or more elements of the base stem 130, the spout 142 and/or the lateral stem 144, among other elements, are formed together as a single part. For example, the first and second parts 131, 132 of the base stem 130 are configurable as a unitary part, such as shown in FIG. 3. Similarly, the bodies of the other embodiments of this application can have a unitary or a multipart design. According to one example, a unitary body/element (e.g., body 103, base stem 130, etc.) can be cast or molded, although other manufacturing processes may be used to form such unitary parts. Similarly, the multipart designs can employ the same or different processes.

Figure 4:
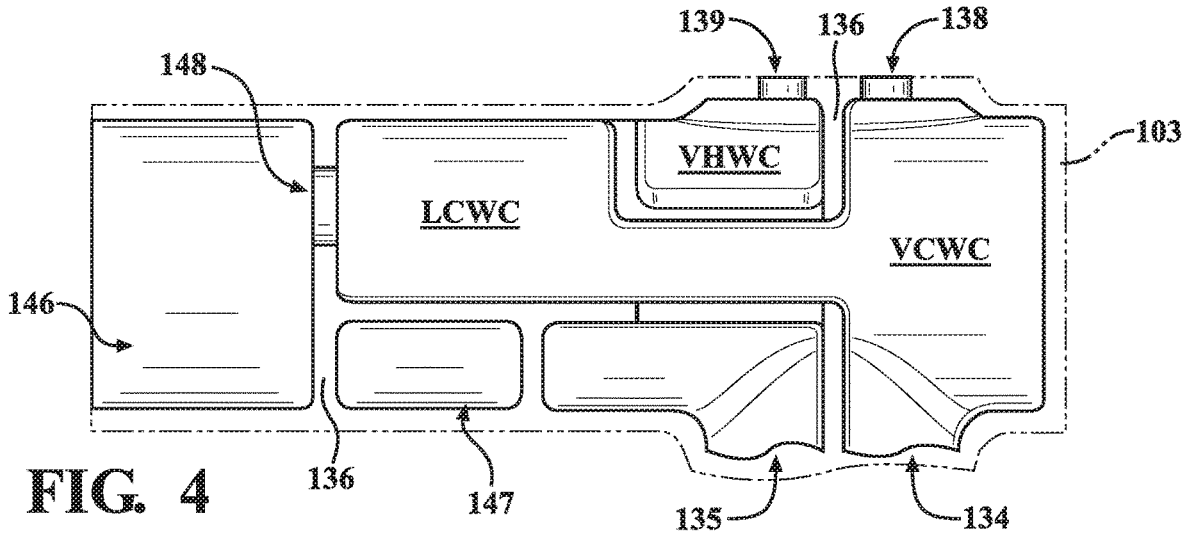
FIG. 4 is a plan view of a portion of the bath filler shown in FIG. 1 showing water flow through the portion.
Figure 5:
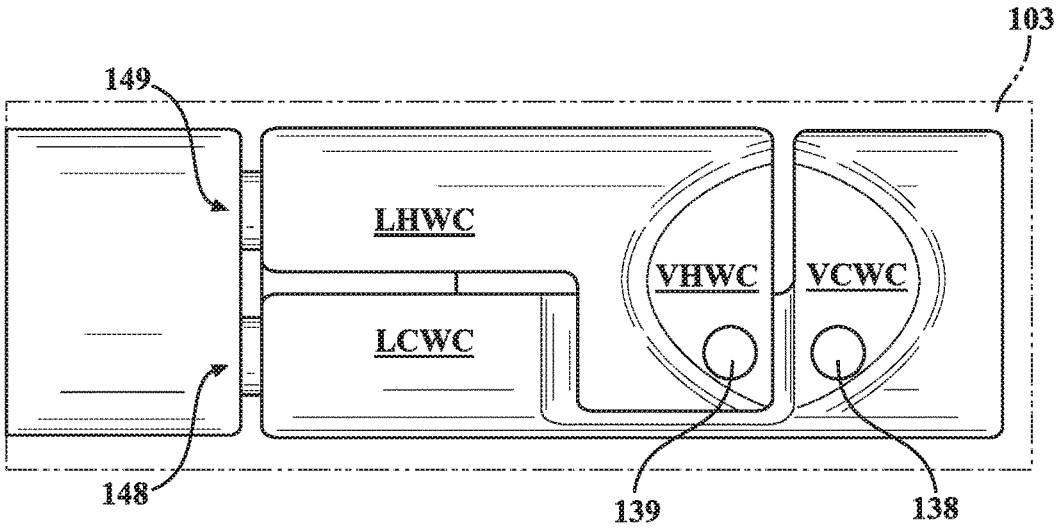
FIG. 5 is a top view of the portion of the bath filler shown in FIG. 4.
Figure 6:
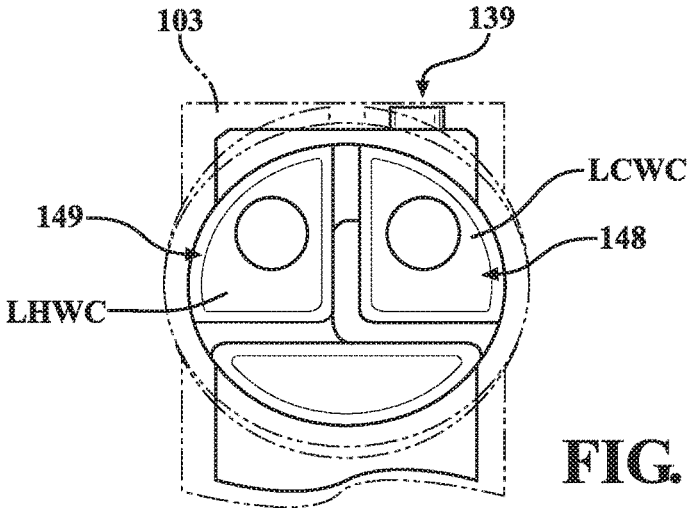
FIG. 6 is a side view of the portion of the bath filler shown in FIG. 4.

FIGS. 4-6 show the flow paths of the cold water and the hot water through the various chambers or passages in the body 103. As shown, cold water enters the body 103 through the first inlet 134 and flows through a vertical cold water chamber VCWC to supply the first valve through the first opening 138 in the upper wall 136 (defining the cup 137) and flows through a lateral cold water chamber LCWC to supply the second valve through a first opening 148 in a lateral wall 136 (defining the cup 146). Also shown, hot water enters the body 103 through the second inlet 135 and flows through a vertical hot water chamber VHWC to supply the first valve through the second opening 139 in the upper wall 136 and flows through a lateral hot water chamber LHWC to supply the second valve through a second opening 149 in the lateral wall 136 of the body 103. FIG. 4 also shows the chamber of the outlet 147. It is noted that both hot and cold water are supplied inside the body 103 to both of the first and second valves simultaneously.

The bath filler 100 can include a valve seat associated with one or both of the valves. As shown in FIGS. 2 and 3, a valve seat 105 is configured to sit within the cup 137, where the valve seat 105 fluidly connects the first valve (e.g., valve 161) to hot and cold water through the first and second openings 138, 139. For example, hot water from the VHWC and cold water from the VCWC flow through the valve seat 105 to supply the first valve with hot and cold water through inlets in the valve.

Figure 13:
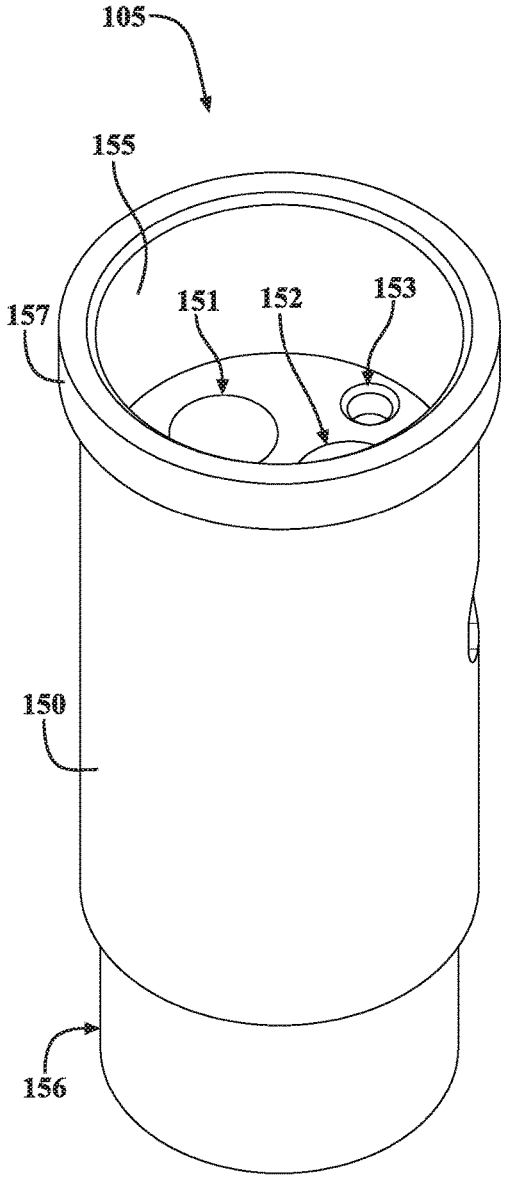
FIG. 13 is a perspective view of a valve seat of the bath filler shown in FIG. 2.
Figure 14:
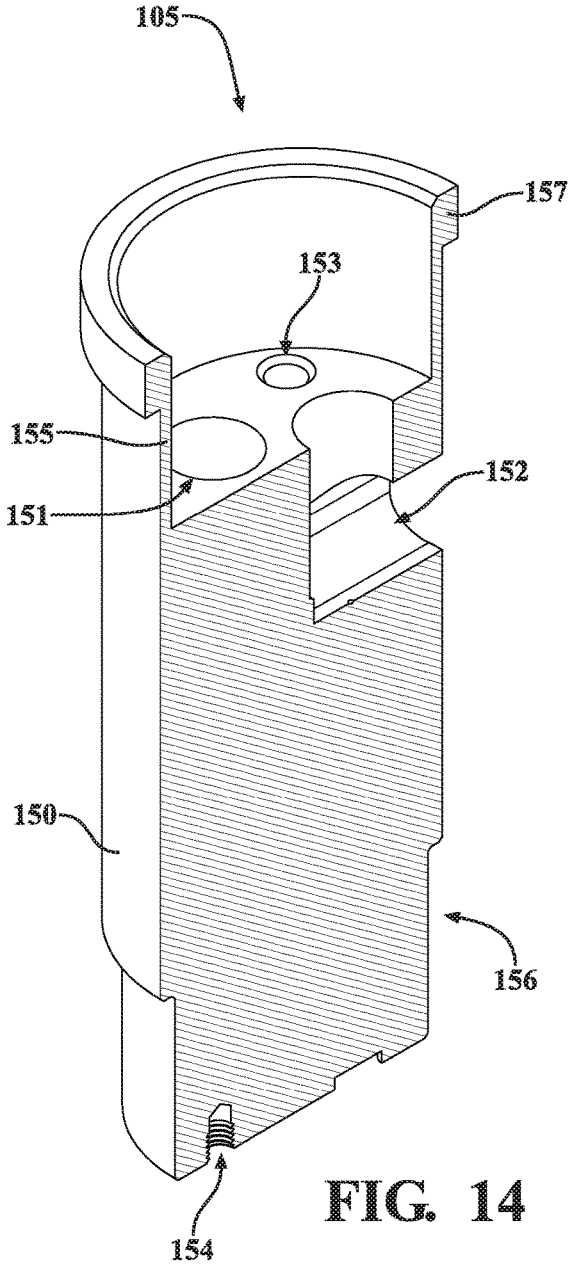
FIG. 14 is a perspective cross-sectional view of the valve seat shown in FIG. 13.

FIGS. 13 and 14 illustrate an example of the valve seat 105. As shown in FIG. 14, the valve seat 105 includes a generally cylindrical base 150 having two inlet ports 151 (only one port is shown in FIG. 14 since the view is a cross section; however FIG. 12 shows both ports 151). Each port 151 fluidly connects to (or communicates with) one of the first and second openings 138, 139 of the body 103 to the first valve. For example, each port 151 can include an internal passage extending through the valve seat 105. Thus, each inlet port 151 extends through the base 150 so that cold/hot water from the respective opening flows through the associated inlet port 151 to the valve. By way of example, the valve seat 105 can be at least partially symmetric, such that the second of the two inlet ports 151 is symmetrically opposite the first inlet port 151 (e.g., via the cutting plane or another plane in FIG. 14). The illustrated base 150 also includes an outlet port 152 for directing hot water, cold water, or a mixture of hot and cold water from the valve to the spout 142. Water enters the illustrated outlet port 152 from the valve through an opening in an upper surface of the base 150 (which also includes openings for the two ports 151) and water exits the outlet port 152 through an opening in a side of the base 150, as shown in FIG. 14.

The valve seat 105 can optionally include one or more locator holes, which can act as "poka-yokes" to control the relative orientation between the valve seat 105 and the first valve and/or the body 103 during assembly/installation. As shown in FIG. 14, a first locator opening 153 (e.g., bore) in the upper surface of the base 150 controls the relative orientation between the valve seat 105 and the first valve, such as through a pin or screw that engages the opening 153 and an associated opening in the valve. A second locator opening 154 in a lower surface (e.g., bottom) of the valve seat 105 controls the relative orientation between the valve seat 105 and an upper wall (e.g., upper lateral internal wall 136*a*) of the body 103, such as through a pin or screw that engages the opening 154 and the third opening 140 in the upper wall. For example, the opening 154 can be in a bottom of the base 150 and/or in a bottom of a shoulder 156, if provided. An annular outer wall 155 extends upwardly from a top of the base 150 and, as shown, has a common outer diameter with the base 150. An inner diameter of the outer wall 155 defines a pocket for receiving the first valve and surrounds the ports 151, 152 and the openings 153 for the valve to access them. Disposed proximate a lower end of the base 150 is a first annular shoulder 156, which can extend radially in or out relative to size (e.g., diameter) of the base 150. For example, the shoulder 156 can have a smaller or larger diameter compared to the outer diameter of the base 150. Disposed proximate an upper end of the outer wall 155 is a second annular shoulder 157, which can extend radially out or in from the outer diameter of the outer wall 155 to thereby have a larger or smaller diameter than the outer diameter of the outer wall 155 and the base 150. Accordingly, there is a distance (e.g., gap) between the first and second annular shoulders 156, 157, such that the valve seat 105 and the outer wall 133 of the body 103 define a fluid passage 158 (see FIG. 3) fluidly connecting the outlet port 152 with the spout 142 (e.g., a fluid passage therein that leads to the outlet).

Also shown in FIGS. 2 and 3, a first valve 161 is received in a bore of the valve seat 105 defined by the outer wall 155 and the base 150, with the valve seat 105 being received in the cup 137 of the base stem 130. The first valve 161 controls the flow and temperature of water from the valve seat 105 to the spout 142. A second valve 162 is received in the cup 146 of the lateral stem 144 for controlling the flow and temperature of water to the outlet 147 for a hand shower or other similar device. Although the first and second valves 161, 162 are shown as cartridge style valves, the valves can be configured differently than shown. Also, the first and second valves 161, 162 can be configured to provide different performance characteristics. For example, the first valve 161 can be configured to provide a higher flow rate (e.g., up to around 17 gal/min or gpm) relative to a flow rate (e.g., up to around 2.5 gal/min) of the second valve 162, since the first valve 161 is configured to fill a bath while the second valve 162 is configured to supply water to a hand shower or other device utilizing much less water. According to another example, the high flow rate valve provides a flow rate up to around 13 gpm at 45 psi. The term "around" used in combination with a gpm denotes a typical tolerance range associated with valves for bath fillers, faucets, and the like, however, at the very least denotes a range of ten percent (10%).

The bath filler (e.g., bath filler 100, 200, etc.) includes at least one controller for controlling operation of the first and second valves (e.g., valves 161, 162). Each controller can include mechanical actuators (e.g., handles, levers, buttons, etc.), electronic actuators (e.g., touchscreen, etc.), or a combination thereof. A first controller can control the first valve, and a second controller can control the second valve, where each controller controls its associated valve independently of the other controller and other valve. As shown in FIGS. 1-3, a first controller in the form of the first handle 101 operatively couples to the first valve 161, such as to a stem thereof, for controlling operation of the first valve 161 in response to movement (e.g., rotation, pivoting, etc.) of the first handle 101. Similarly, a second controller in the form of the second handle 102 operatively couples to the second valve 162, such as a stem thereof, for controlling operation of the second valve 162 in response to movement of the second handle 102. Each handle 101, 102 is controllable independently of the other. As such, each valve 161, 162 is controllable independently of the other. The independent functionality advantageously allows the first and second valves to provide water at different flow rates and/or different temperatures to two separate outlets/devices (e.g., a bath, a hand shower) simultaneously.

Also shown in FIGS. 2 and 3, a valve nut 163 is provided to secure the first valve 161 to the valve seat 105. The illustrated valve nut 163 is substantially annular in shape having a body that overlies a first part of the first valve 161, a central opening in the body for receiving a second part of the first valve 161 (e.g., a shoulder through which the stem passes), and external threads provided around an exterior of the body that thread to internal threads in an upper end of the second portion 132 of the base stem 130. For example, the portion of the upper end defining the opening 143 can include the internal threads.

A bonnet 165 (e.g., first bonnet) is shown in FIG. 3 coupled to the valve nut 163 and/or the upper end of the second portion 132 of the base stem 130. For example, the bonnet 165 can include internal threads that thread to another set of external threads around an inner shoulder of the valve nut 163, where the inner shoulder extends upward from the body. Alternatively, the bonnet 165 can be coupled through a fastener (e.g., set screw) or in other suitable ways. The illustrated bonnet 165 includes an upwardly extending cylindrical portion that surrounds the shoulder and stem of the first valve 161 and part of the valve nut 163 (e.g., the inner shoulder thereof). An outer wall of the first handle 101 surrounds at least part of the bonnet 165 (e.g., at least part of the cylindrical portion).

Figure 7:
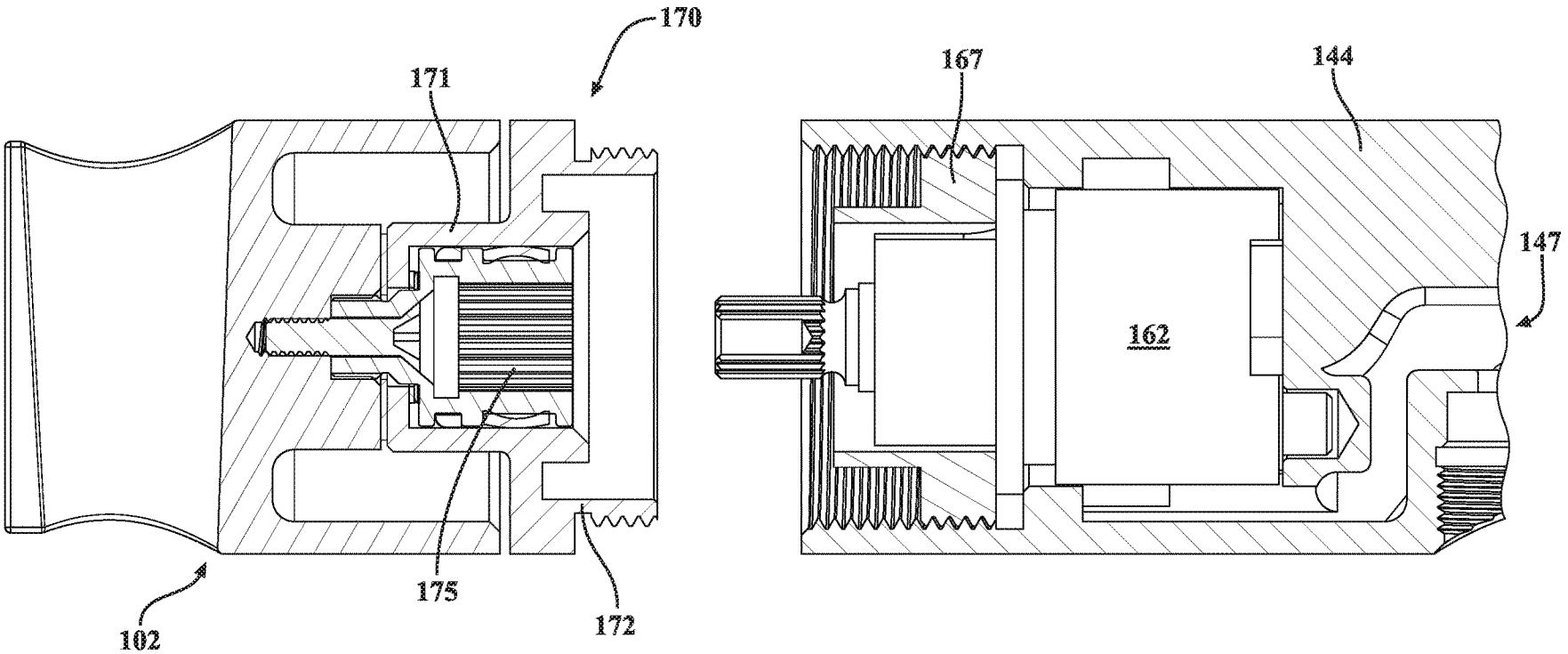
FIG. 7 is a side partially exploded cross-sectional view of a portion of the bath filler shown in FIG. 3.

FIGS. 2, 3 and 7 illustrate a valve nut 167 configured to secure the second valve 162 in the cup 146 of the lateral stem 144. The illustrated valve nut 167 is substantially annular in shape having a body that overlies a first part of the second valve 162, a central opening in the body for receiving a second part of the second valve 162 (e.g., a shoulder through which the stem passes), and external threads provided around an exterior of the body that thread to internal threads in the open distal end of the lateral stem 144.

Figure 8:
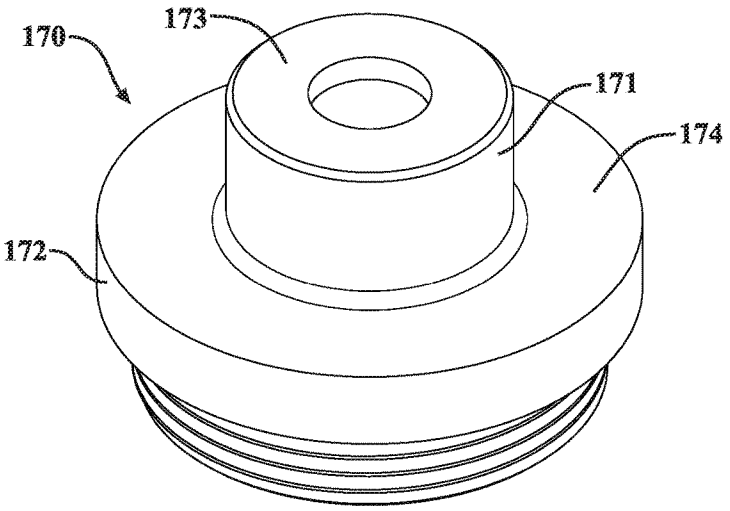
FIG. 8 is a perspective view of a bonnet of the bath filler shown in FIG. 1.
Figure 9:
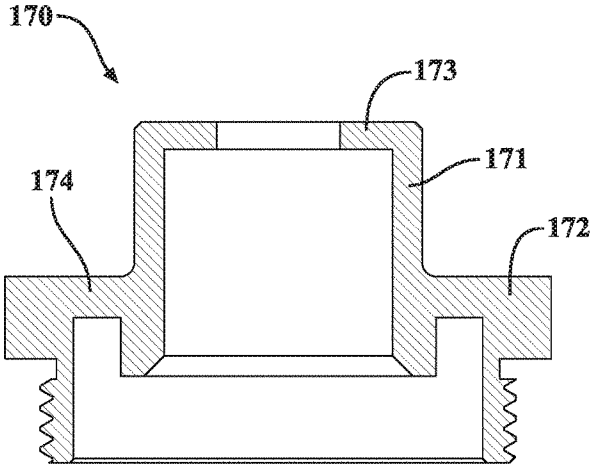
FIG. 9 is a side cross-sectional view of the bonnet shown in FIG. 8.

FIGS. 7-9 illustrate a bonnet 170 (e.g., second bonnet) received in the open distal end of the lateral stem 144 for operably coupling the stem of the second valve 162 to the second handle 102. The bonnet 170 includes a first cylindrical portion 171 that extends between first and second ends and is configured to receive part of a splined post 175, which can be rotatably coupled to the bonnet 170 through a bearing and/or secured to the second handle 102 through a fastener (screw shown in FIG. 7). A radial flange 173 extends inwardly from the first end and includes an opening therein for receiving another part of the splined post 175 that is configured to drive movement (e.g., rotation, pivoting, etc.) of the stem of the second valve 162 in response to movement of the second handle 102. A radial flange 174 extends outwardly from the second end of the first cylindrical portion 171, and a second cylindrical portion 172 extends away from an outer end of the outward radial flange 174. The portion 172 can include threads (e.g., external threads as shown in FIGS. 7-9) that thread to threads (e.g., internal threads) in an end of the lateral stem 144 to secure the bonnet 170 to the stem 144.

Figure 10:
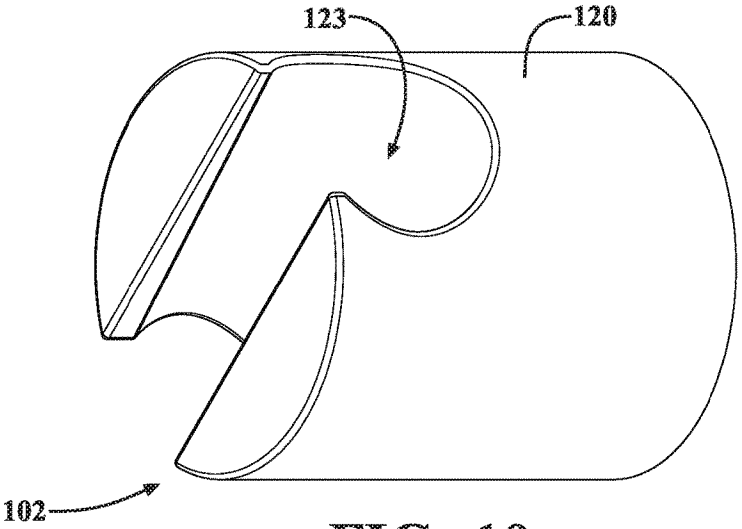
FIG. 10 is a perspective view of a handle of the bath filler shown in FIG. 1.
Figure 11:
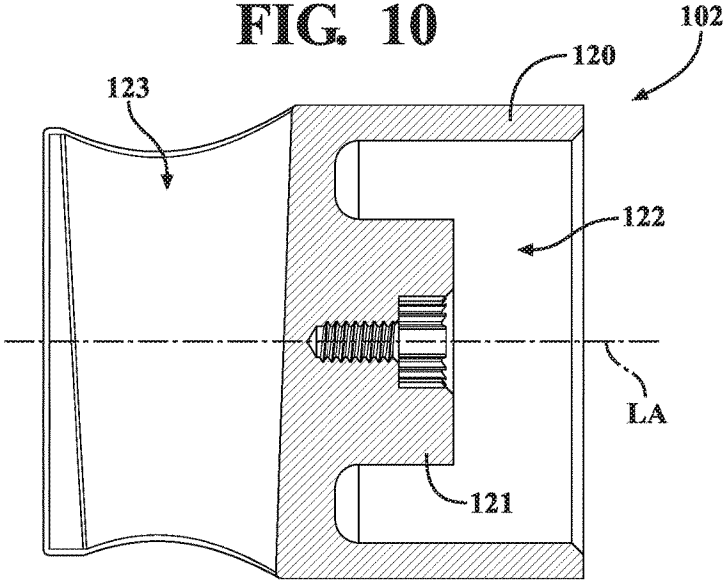
FIG. 11 is a side cross-sectional view of the handle shown in FIG. 10.

FIGS. 7, 10 and 11 illustrate an example of the second handle 102 that includes a cylindrical body 120 extending along a longitudinal axis LA. Extending in a first end of the body 120 is a bore 122 further defined by an inner shoulder 121 extending toward an opening of the bore 122. The shoulder 121 includes a splined bore that is configured to receive a first set of splines of the splined post 175 to transmit motion (e.g., rotational motion), such that movement of the second handle 102 moves the splined post 175, which controls the second valve 162 through interconnected splines of a valve stem of the valve 162 and the splined post 175 (e.g., internal splines). The body 120 includes a transverse bore 123 extending through a second end in a direction that is substantially transverse to the longitudinal axis LA. The transverse bore 123 can be cylindrical or have another suitable shape (e.g., frusto-conical), such as to facilitate movement of the second handle 102 and/or to receive another object (e.g., a base or handle of a hand shower). Accordingly, the handle 102 includes a docking member in the end defining the bore 123, wherein a portion of a movable hand shower (e.g., handle) detachably docks with the docking member in a docked position. The hand shower is fluidly connected to the outlet 147 in the stem 144, such as through a hose, fluid conduit, or other similar element.

Figure 15:
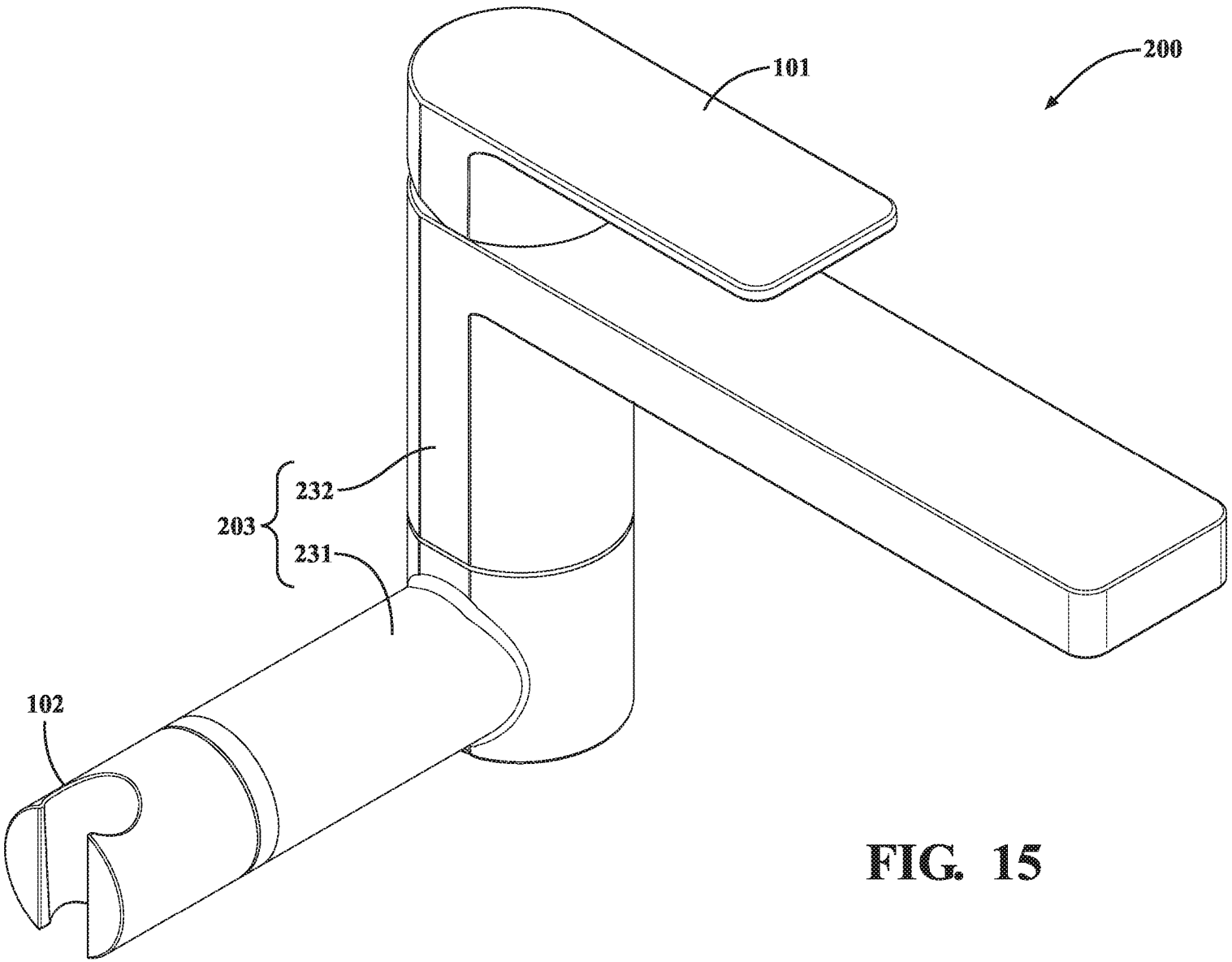
FIG. 15 is a perspective view of a bath filler, according to this application.
Figure 16:
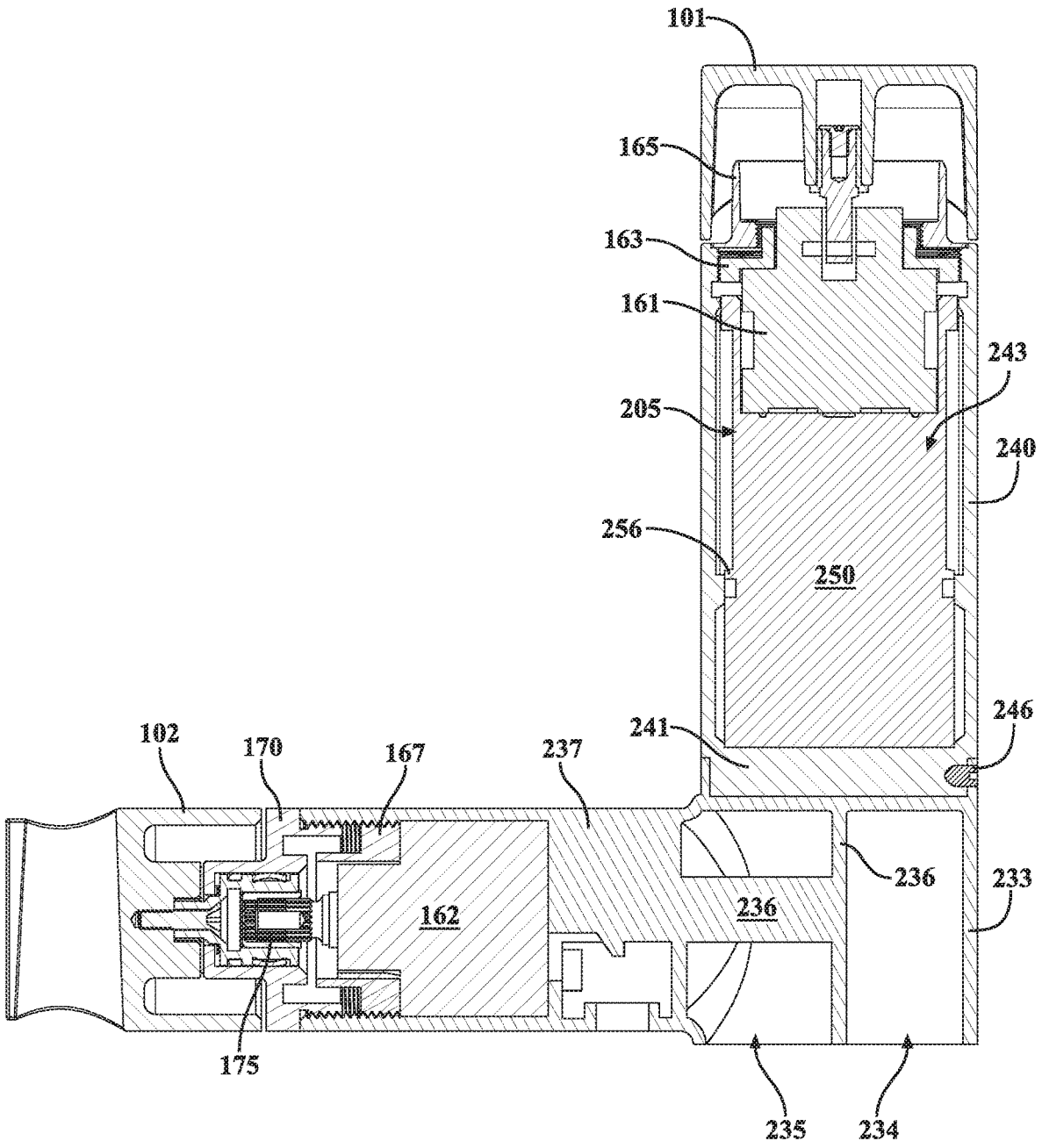
FIG. 16 is a side cross-sectional view of the bath filler shown in FIG. 15.
Figure 17:
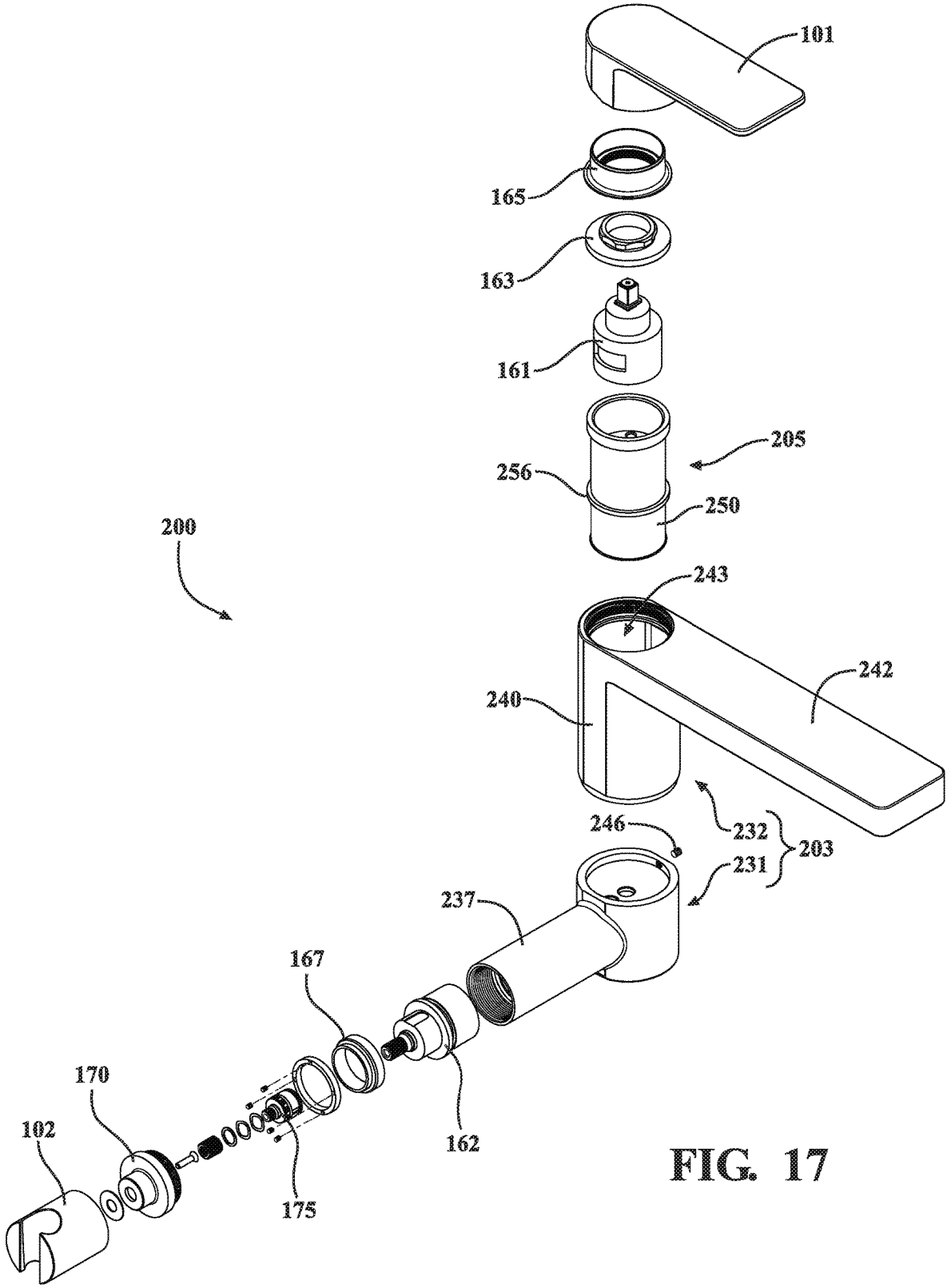
FIG. 17 is an exploded perspective view of the bath filler shown in FIG. 15.
Figure 18:
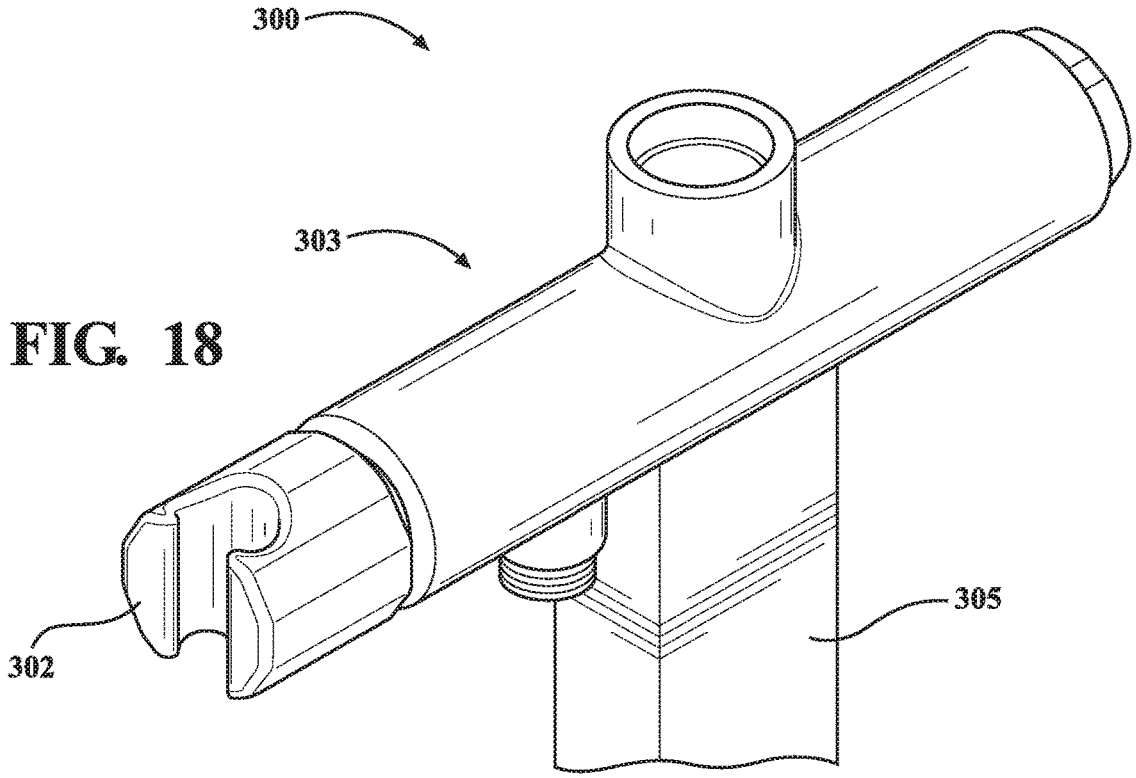
FIG. 18 is a perspective view of a bath filler, according to this application.
Figure 19:
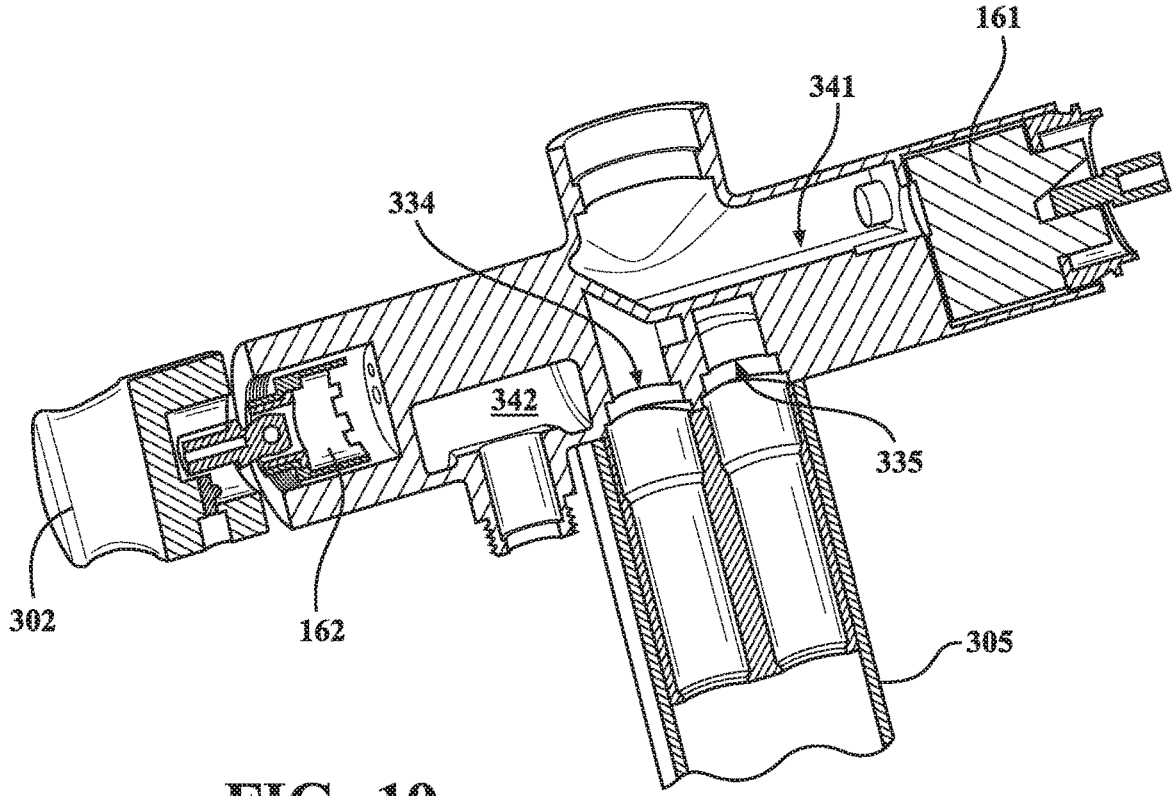
FIG. 19 is a perspective cross-sectional view of the bath filler shown in FIG. 18.
Figure 20:
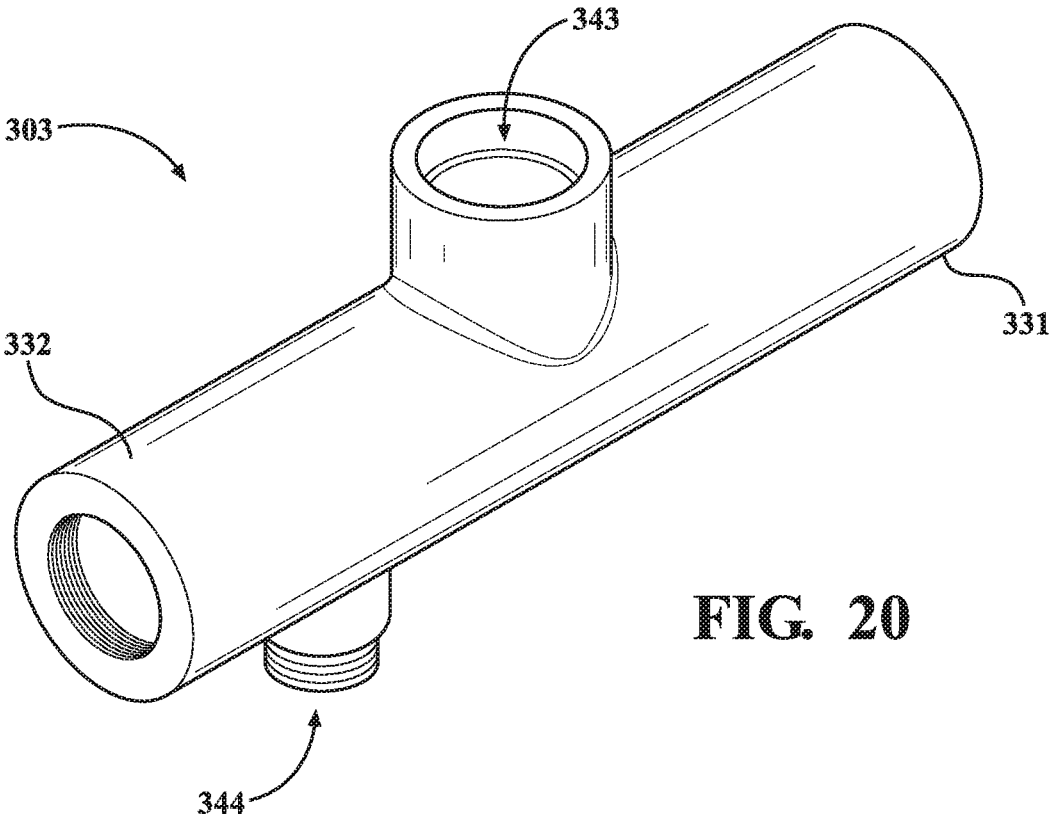
FIG. 20 is a perspective view of a waterway of the bath filler shown in FIG. 18.
Figure 21:
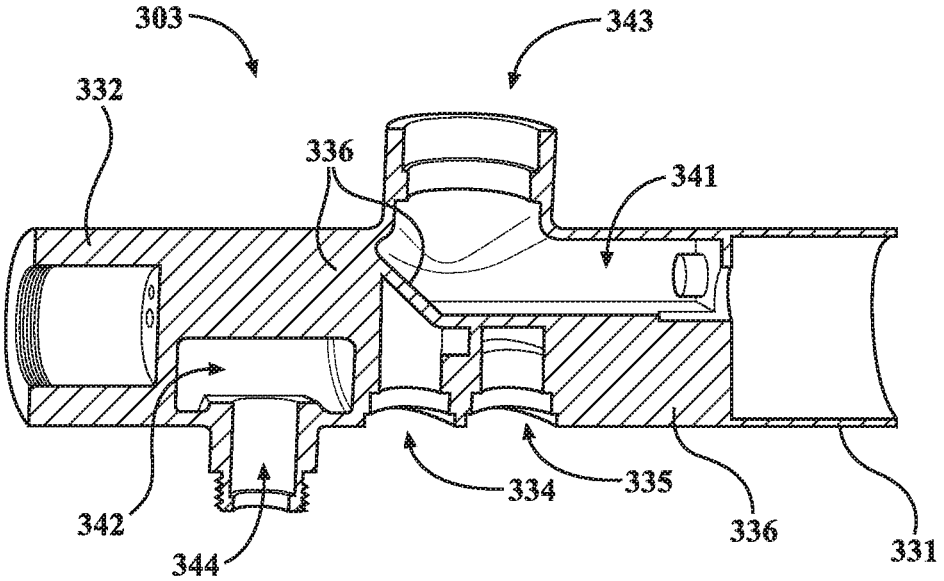
FIG. 21 is a perspective cross-sectional view of the waterway shown in FIG. 20.

FIGS. 15-17 illustrate an example of a bath filler 200 that is configured the same as the bath filler 100, except the body 203 of the bath filler 200 is a two-piece assembly and the valve seat 205 is taller. That is, the body 203 includes first and second parts 231, 232 that are formed separately, then are coupled together. As shown best in FIGS. 16 and 17, the first part 231 of the body 203 includes a cylindrical base portion 233, which includes cold and hot water inlets 234, 235, respectively, and a lateral stem 237 extending from the base portion 233. The illustrated lateral stem 237 is basically the same as the lateral stem 144 described above, so no further explanation is provided or warranted. One or more internal walls 236 divide the interior of the first part 231 into chambers (e.g., hot water chamber, cold water chamber, outlet chamber). Thus, the fluid flow from the cold and hot water inlets 234, 235 to the second valve 162 is basically the same as described above.

The second part 232 of the body 203 includes a longitudinal stem 240 having a base wall 241 configured to mount on the base portion 233 of the first part 231. As shown in FIG. 17 a fastener 246 (e.g., set screw) can couple the first and second parts 231, 232 together. The base wall 241 has openings (e.g., first, second, and/or third openings), such as described above for the upper wall 136 having the openings 138, 139, 140 therein, that facilitate water flow from the base portion 233 of the first part 231 and/or provide poka-yoke feature(s). The second part 232 includes a spout 242 extending from a top of the longitudinal stem 240. A bore 243 extends into the top of the longitudinal stem 240 and/or the spout 242, where the bore 243 is configured to receive the valve seat 205. The valve seat 205 is basically the same as the valve seat 105, except a base 250 of the valve seat 205 is taller than the base 150, in order to position the first valve 161 at the correct height (e.g., the same height as the body 103), and a lower or first annular shoulder 256 is seated around a portion between the ends of the valve seat 205 rather than proximate a lower end.

FIGS. 18-21 illustrate an example of a bath filler 300 that includes a unitary (e.g., one-piece) body 303 having a generally cylindrical shape extending between a first end 331 and a second end 332. Disposed at the first end 331 is a first valve 161; and disposed at the second end 332 is a second valve 162. As shown best in FIGS. 20 and 21, the body 303 includes cold and hot water inlets 334, 335, which are shown coupled to a waterway 305 in FIGS. 18 and 19, where the waterway 305 supplies cold and hot water to the body 303. The body 303 includes internal walls 336 that are configured to divide the body 303 into cold and hot water chambers for supplying both the first and second valves 161, 162, as well as into a first outlet chamber 341 associated with the first valve 161, and a second outlet chamber 342 associated with the second valve 162 (see FIG. 21). A first outlet 343 is fluidly connected with the first outlet chamber 341 to supply water to a first device (e.g., spout) or for a first purpose (e.g., fill a bath). A second outlet 344 is fluidly connected with the second outlet chamber 342 to supply water to a second device (e.g., hand shower, shower, etc.) or for another purpose. A first handle can be operatively coupled to the first valve 161 to control temperature and/or flow rate of water to the first outlet 343 from the first valve 161, and a second handle 302 can be operatively coupled to the second valve 162 to control temperature and/or flow rate of water to the second outlet 344 from the second valve 162. Although the first and second ends 331, 332 are shown to share a common axis (e.g., longitudinal axis), the ends 331, 332 can be offset (e.g., set along parallel axes), orthogonally aligned, or aligned at an angle (e.g., between zero and ninety degrees).

Figure 22:
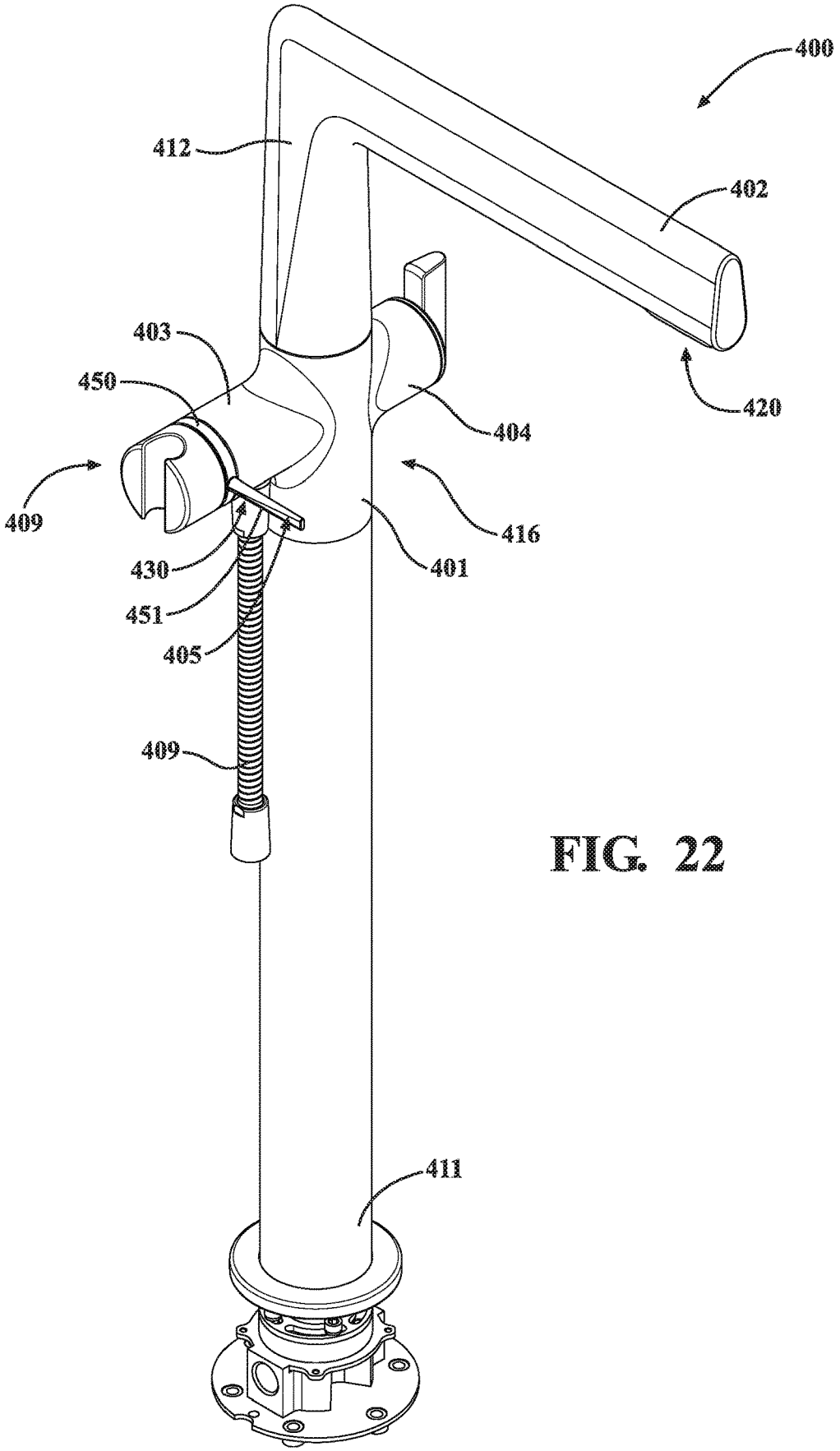
FIG. 22 is a perspective view of a bath filler, according to this application.
Figure 23:
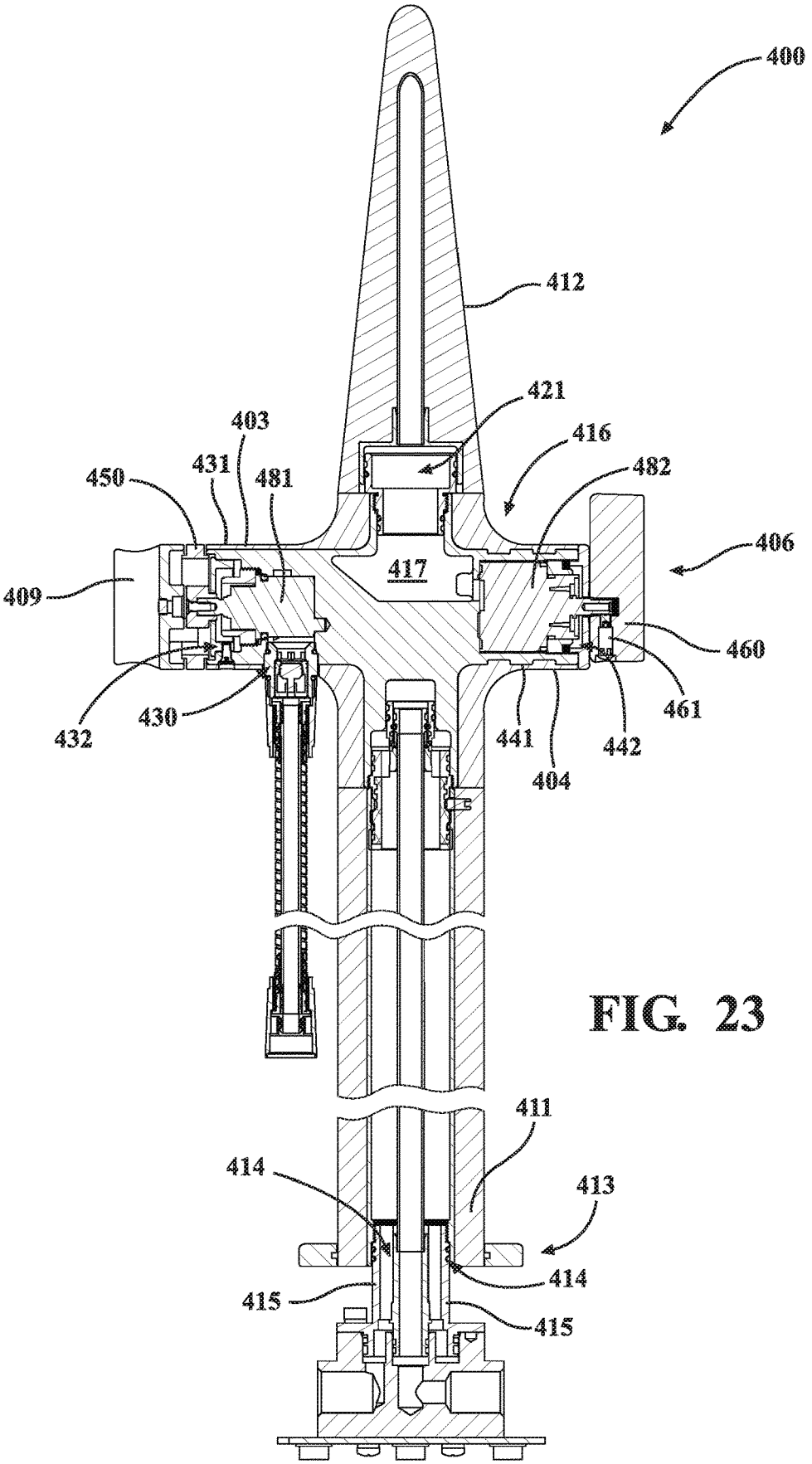
FIG. 23 is a front cross-sectional view of the bath filler shown in FIG. 22.

FIGS. 22 and 23 illustrate an example of a bath filler 400 that provides independent control of two water outputs, such that the first output can have a different temperature and/or flow rate compared to the first output. As shown, the bath filler 400 includes a body 401, a spout 402, an accessory stem 403 (e.g., first stem), and a faucet stem 404 (e.g., second stem). The body 401 extends between first and second ends 411, 412. The body 401 can have a generally hollow shape, such as cylindrical as shown, or another suitable shape, to define fluid passages/chambers within and/or receive other elements. The lower or first end 411 includes a base 413, which mounts the body 401 to another object (e.g., tub, floor, etc.) and which includes an inlet 414 for receiving each of hot and cold water, such as through hot and cold water lines 415. The spout 402 extends from the body 401 proximate the second end 412 and has an outlet 420 (e.g., first outlet), such as at an outlet end thereof to supply water for filing a bath or tub. Disposed between the first and second ends 411, 412, the body 401 includes a central portion 416 that receives the stems and valves, as discussed below. The central portion 416 includes a waterway having fluid passages/chambers, such as those discussed herein, that fluidly connect the hot and cold water to each valve and that fluidly connect each valve to the respective outlet. For example, an outlet passage 417 within the central portion 406 fluidly connects an outlet of the valve 482 to an inlet 421 of the spout 402, as shown in FIG. 23.

The first or accessory stem 403 extends from a first side of the central portion 416 of the body 401. As shown, the stem 403 has a generally cylindrical hollow shape, but can be configured differently than shown. The stem 403 and has an outlet 430 (e.g., second outlet of the filler) that is fluidly connected to an outlet of a valve 481 (e.g., first valve) to supply water at a set temperature from the valve 481 to a first device, such as a moveable hand shower or other suitable device. Although a hose 409 is shown having a first end, which fluidly connects to the outlet 430, and a second end, which fluidly connects to the first device (e.g., moveable hand shower), the bath filler 400 may employ other fluid connectors. The first stem 403 includes an outer body 431 that can be integrally formed with (or formed separately then coupled to) the body 401. As shown, the outer body 431 is generally cylindrical in shape with the outlet 430 and an open end 432 for receiving and housing the valve 481 and/or other elements. Notably, the outer body 431 and/or the stem 403 may take other shapes and/or have other configurations.

The second or faucet stem 404 extends from a second side of the body 401. As shown, the second side is opposite the first side of the body 401. However, the first and second sides can have any suitable configuration including at different radial angles (other than 180°), at different elevations on the body 401, and so forth. The second stem 404 includes an outer body 441 that can be integrally formed with (or formed separately then coupled to) the body 401. As shown, the outer body 441 of the faucet stem 404 is generally cylindrical in shape with an open end 442 for receiving and housing a valve 482 (e.g., second valve) and/or other elements. Notably, the outer body 441 and/or the stem 404 may take other shapes and/or have other configurations.

The first valve 481 is received through the open end 432 of the outer body 431 and is housed within the first stem 403 by itself (or in combination with the body 401). The first valve 481 controls a flow rate and/or a temperature of water from the inlets 414 of the body 401 to the outlet 430 associated with the first stem 403.

The second valve 482 is received through the open end 442 of the outer body 441 and is housed within the second stem 404 by itself (or in combination with the body 401). The second valve 482 controls a flow rate and/or a temperature of water from the inlet 414 of the body 401 to the outlet 420 in the spout 402.

Notably, each valve 481, 482 is controllable/operable independent of the other valve. Thus, a user can fill a bath with water at a first setting (including temperature and/or flow rate), and spray water from a hand shower at a second setting (including temperature and/or flow rate), where the first and second settings can be the same or different. The bath filler 400 includes a controller for controlling each valve 481, 482. As shown in FIGS. 22 and 23, the controller associated with the valve 481 (e.g., first valve) is a mechanical actuator in the form of a handle 405. The handle 405 includes an annular body 450, which is disposed at an outer end of the stem 403, and may have an outer diameter that is the same as an outer diameter of the outer body 431 of the stem 403. The handle 405 includes an arm 451 (e.g., finger, leg, projection, etc.) that extends radially outward from the annular body 450 to allow a user to grasp the arm 451 to rotate the handle 405 relative to the outer body 431. The body 450 operably couples to the valve 481, such as through a splined connector, so that rotation of the handle 405 adjusts the valve 481 (e.g., a valve stem thereof) to control a flow rate and/or a temperature of water from the valve 481 to the outlet 430 in the stem 403. Also shown, the controller associated with the valve 482 (e.g., second valve) is a mechanical actuator in the form of a handle 406. The handle 406 includes an elongated body 460 that is disposed at the outer end of the stem 404 (rather than on the spout). The body 460 operably couples to the valve 482 (e.g., a valve stem thereof), such as through a spline connection, so that rotation of the handle 406 (relative to the stem 404) adjusts the valve 482 to control a flow rate and/or a temperature of water from the valve 482 to the outlet 420 in the spout 402. As shown, a screw 461 (e.g., set screw) secures the body 460 to the valve 482 (e.g., valve stem). Notably each controller can take the form of other types of handles, mechanical actuators, electronic actuators, or combinations thereof.

The bath filler 400 may optionally include a docking member/element. As shown in FIGS. 22 and 23, the bath filler 400 includes a docking member 409 configured to retain a portion (e.g., handle) of a device, such as a movable hand shower. The docking member 409 can be configured the same as or similar to the docking member of the other handles (e.g., handle 102) discussed herein. However, the docking member 409 can couple to the annular body 450 of the handle 405, such that the docking member 409 rotates with the handle 405, or can couple to an outer end of the stem 403 or another element fixed relative to the stem 404, such as a valve nut (e.g., valve nut 167), such that the docking member 409 remains stationary while the handle 405 rotates. The handle 405 is disposed between the outer end of the stem 403 and an inner end of the docking member 409. Thus, in a first embodiment, the handle 405 is rotatable relative to the stem 403 and/or the docking member 409 to adjust the second valve 461. In the first embodiment, the docking member 409 can be fixed to or rotatable relative to the stem 403. For the latter, the docking member 409 and handle 405 are able to rotate independently from the other relative to the stem 403. In a second embodiment, the handle 405 and the docking member 409 rotate together relative to the stem 403. Notably, the docking member 409 can be located elsewhere on the bath filler 400; however, locating it on the stem 403 makes it more intuitive that the handle 405 operates the flow of water to the device configured to dock on the docking member 409.

Figure 24:
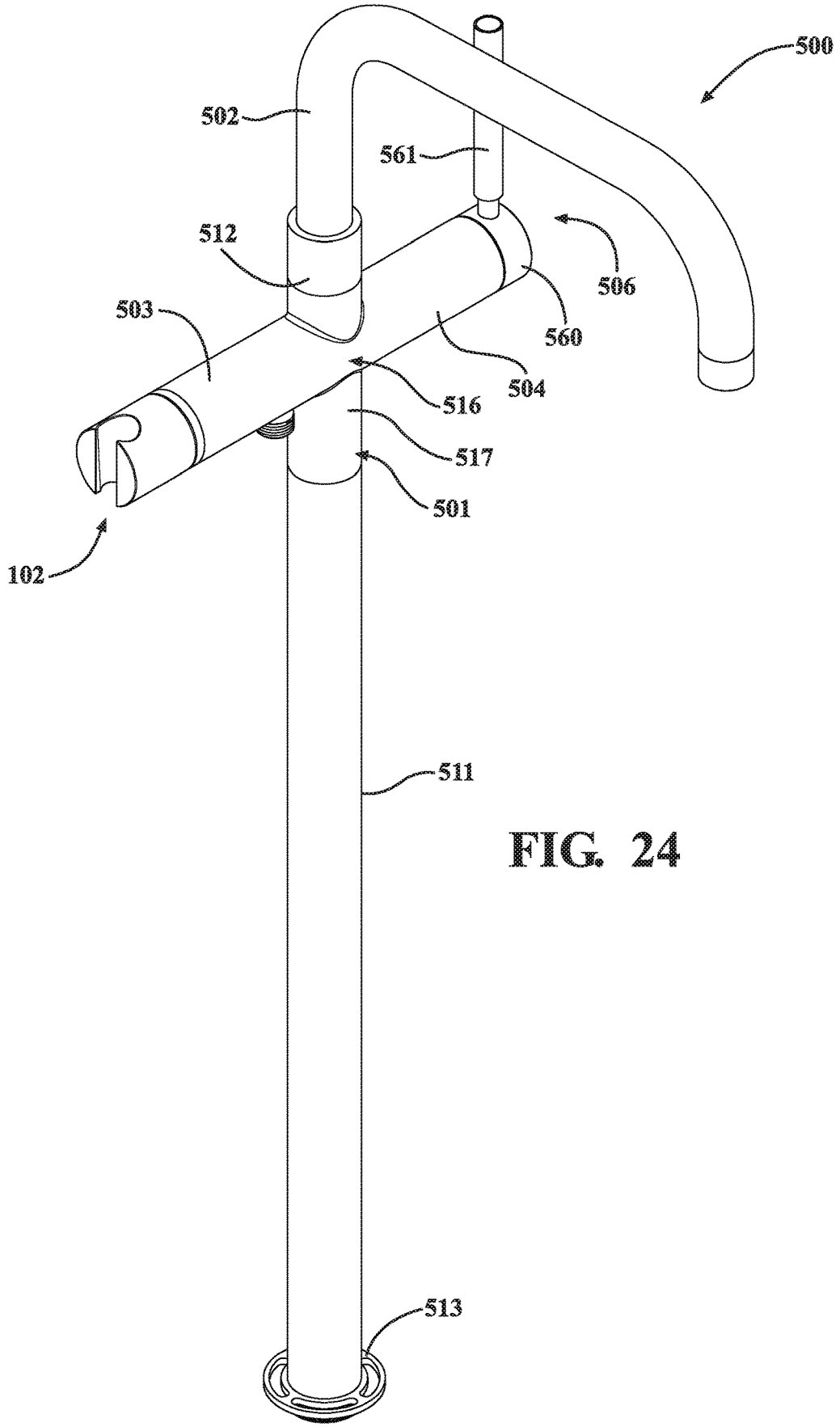
FIG. 24 is a perspective view of a bath filler, according to this application.
Figure 25:
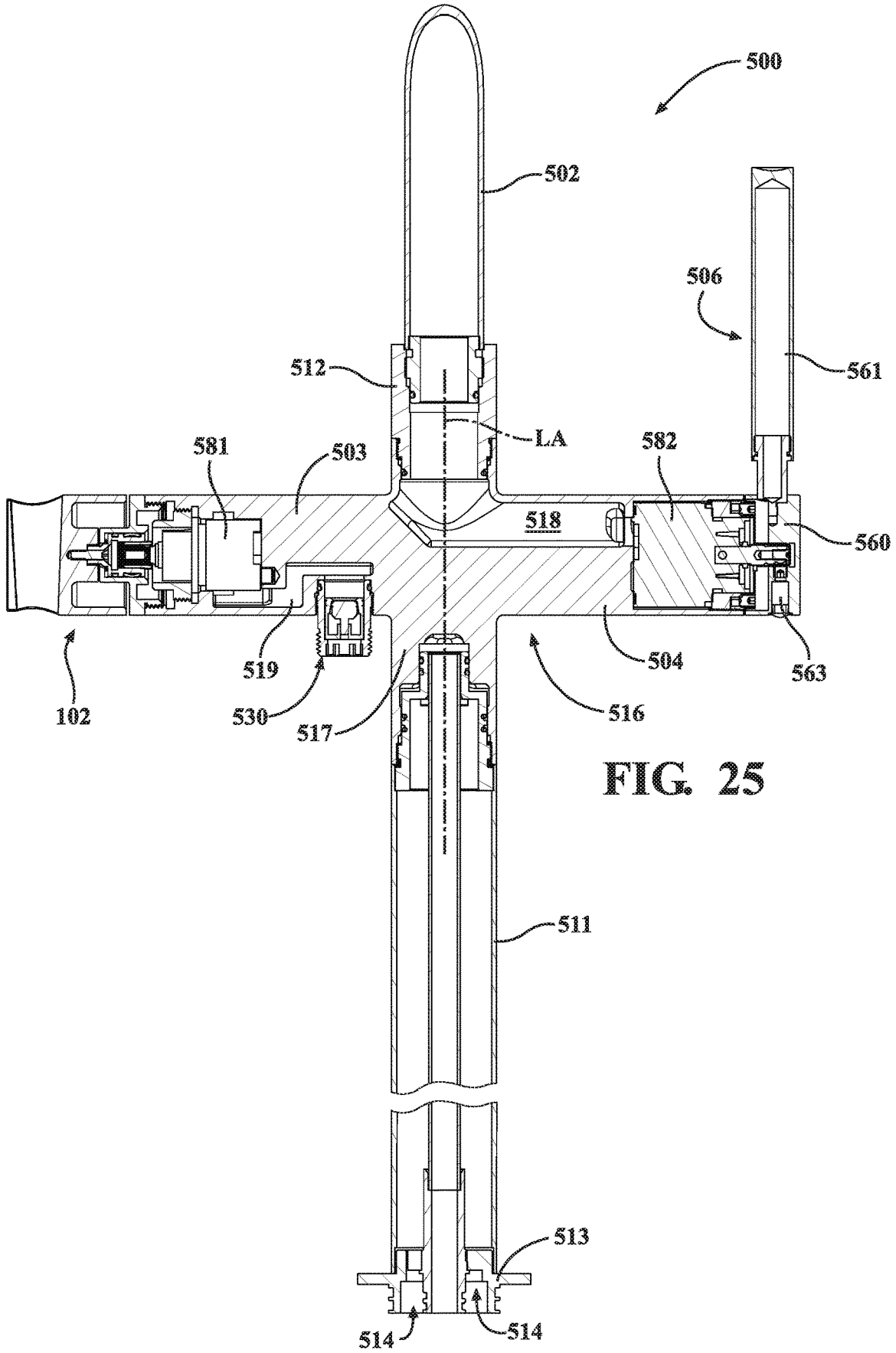
FIG. 25 is a front cross-sectional view of the bath filler shown in FIG. 24.

FIGS. 24 and 25 illustrate an example of another bath filler 500 that provides independent control of two water outputs, such that the first output can have a different temperature and/or flow rate compared to the first output. As shown, the bath filler 500 includes a body 501 and a spout 502 extending from a top part of the body 501. The illustrated body 501 includes a lower portion 511, which has a base 513 with inlets 514 for receiving hot and cold water, an upper portion 512 fluidly connecting and supporting the spout 502, and a central portion 516. The central portion 516 includes a longitudinal portion 517, which extends along a longitudinal axis LA and has a first or lower end coupled to the lower portion 511 and a second or upper end coupled to the upper portion 512. The longitudinal axis LA is aligned vertically in FIG. 25; however, the longitudinal axis LA can be aligned obliquely (relative to vertical). As shown, the central portion 516 includes a first stem 503 extending from a first side of the longitudinal portion 517, and a second stem 504 extending from a second side of the longitudinal portion 517. As shown, the first and second sides are on opposite sides and the stems 503, 504 extend along a lateral axis, which is transverse to the longitudinal axis, such that the central portion 516 has a cross shape; however, these elements can form alternative shapes, such as where the stems extend obliquely or otherwise. The central portion 516 acts as a waterway for routing hot and cold water received through the inlets 514 to the first and second valves 581, 582, as well as routing water from each valve 581, 582 to an associated outlet. FIG. 25 shows a passage 518 (e.g., chamber) within the waterway (e.g., central portion 516) fluidly connecting the outlet of the valve 582 to the spout 502; and a passage 519 within the waterway fluidly connecting the outlet of the valve 581 to an outlet 530, which is configured to supply water to a device (e.g., movable hand shower).

Each of the stems 503, 504 define a cavity (e.g., cup, bore, etc.) in an outer end thereof that receives the associated valve 581, 582. A valve nut or other suitable element retains each valve 581, 582 in the associated cavity of the associated stem 503, 504.

Disposed on an outer end of the stem 503 is an actuator or controller that operably couples to the valve 581 to control a flow rate and/or a temperature of water from the valve 581 into the passage 519. Although the controller, as shown, is the same as the handle 102, the controller can be the same as the handle 405 or any other suitable handle or element.

Disposed on an outer end of the stem 504 is an actuator or controller that operably couples to the valve 582 to control a flow rate and/or a temperature of water from the valve 582 into the passage 518. As shown, the controller includes a handle 506 having a base 560 and an arm 561 extending from the base 560. The illustrated base 560 is circular in shape to match the shape of the stem 504 and is disposed on the outer end of the stem 504 covering the valve 582. The base 560 operatively couples to the valve 582, such as using a screw 563 the secures the base 560 to a valve stem of the valve 582, so that rotation of the controller controls the valve 582. The arm 561 extends radially away from the base 560 to allow a user to grasp the arm 561 to rotate the controller and in turn rotate the valve stem.

It is noted that for each embodiment disclosed herein, the hot and cold water inlets can be reversed or swapped, which would reverse or swap the associated hot and cold water chambers, openings, ports, and so forth. The stems can be reversed, such that a movable hand shower docks and/or is controlled by a right side stem (when facing the filler), or altogether reconfigured, such that the stems are located in different locations.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the bath fillers as shown in the various exemplary embodiments is illustrative only. Additionally, any element disclosed in one embodiment may be incorporated or utilized with any other embodiment disclosed herein. For example, the body, walls, openings, chambers, etc. of any one exemplary embodiment described herein may be incorporated in any other exemplary embodiment described herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A free standing bath filler, comprising:

a body having an inlet comprising a hot water chamber configured to receive hot water and a cold water chamber configured to receive cold water, a first outlet, and a second outlet;

a first valve located within the body and configured to control both a flow rate and a mixture of water from the hot water chamber and the cold water chamber in the inlet to the first outlet;

a second valve located within the body and configured to control both a flow rate and a mixture of water from the hot water chamber and the cold water chamber in the inlet to the second outlet;

a first controller configured to control an operation of the first valve; and a second controller configured to control an operation of the second valve, wherein each controller is operable independently of the other controller.

2. The bath filler of claim 1, wherein the body comprises:

a base stem having the inlet and housing the first valve; and a lateral stem extending from a side of the base stem and housing the second valve.

3. The bath filler of claim 2, wherein the base stem includes an outer wall and one or more internal walls defining hot and cold water chambers within the base stem.

4. The bath filler of claim 3, wherein the one or more internal walls comprise a first internal wall defining with the outer wall a cup that receives the first valve therein, the first internal wall comprising:

a first opening fluidly connecting the first valve to the cold water chamber;

a second opening fluidly connecting the first valve to the hot water chamber; and a third opening that locates a position of a valve seat relative to the body, wherein the valve seat is positioned between the first valve and the internal wall.

5. The bath filler of claim 4, wherein the body comprises a spout extending from an upper end of the base stem, the spout including a fluid passage that fluidly connects the first outlet to an outlet of the first valve.

6. The bath filler of claim 3, wherein the lateral stem includes an outer wall and one or more internal walls defining:

a hot water chamber within the lateral stem and in fluid communication with the hot water chamber in the base stem and the second valve; and a cold water chamber within the lateral stem and in fluid communication with the cold water chamber in the base stem and the second valve.

7. The bath filler of claim 6, wherein the one or more internal walls of the lateral stem further define the second outlet, which is in fluid communication with an outlet of the second valve.

8. The bath filler of claim 7, wherein the second controller is a mechanical actuator that is rotatable relative to the lateral stem.

9. The bath filler of claim 8, further comprising a docking member configured to retain a hand shower, wherein the mechanical actuator is disposed between an outer end of the lateral stem and an inner end of the docking member.

10. The bath filler of claim 1, wherein one of the first and second valves has a maximum flow rate that is greater than or equal to 13 gpm and the other of the first and second valves has a maximum flow rate that is less than or equal to 3 gpm.

11. The bath filler of claim 1, wherein one of the first and second valves has a maximum flow rate that is at least three times greater than a maximum flow rate of the other of the first and second valves.

12. A free standing bath filler, comprising:

a body comprising:

a single inlet configured to receive hot and cold water;

a first stem fluidly connecting the inlet to a first outlet; and a second stem coupled to the first stem and fluidly connecting the inlet to a second outlet;

a first valve located within the first stem and configured to control both a flow rate and a mixture of the hot and cold water from the inlet to the first outlet; and a second valve located within the second stem and configured to control both a flow rate and a mixture of the hot and cold water from the inlet to the second outlet, wherein the each valve is operable independently of the other valve.

13. The bath filler of claim 12, further comprising:

a first controller operatively coupled to and configured to control the first valve; and a second controller operatively coupled to and configured to control the second valve, wherein each controller is operable independently of the other controller.

14. The bath filler of claim 13, further comprising a docking member configured to retain a hand shower, wherein the second controller is a mechanical actuator that is disposed between an outer end of the second stem and an inner end of the docking member.

15. The bath filler of claim 13, wherein the second controller comprises a docking member configured to retain a hand shower, and the second controller is rotatably coupled to an outer end of the second stem with the second valve housed in the outer end.

16. A free standing bath filler, comprising:

a body extending between first and second ends, the first end including an inlet configured to receive hot and cold water;

a spout extending from the body and having a first outlet; and a stem extending from the body and having a second outlet;

a first valve located within the body and configured to control a flow rate and a mixture of the hot and cold water from the inlet to the first outlet; and a second valve located within the stem and configured to control a flow rate and a mixture of the hot and cold water from the inlet to the second outlet, wherein the each valve is operable independently of the other valve.

17. The bath filler of claim 16, wherein the stem extends from the body at a first location that is between the first and second ends of the body.

18. The bath filler of claim 17, wherein the spout extends from the body at a second location that is between the second end and the first location.

19. The bath filler of claim 18, further comprising:

a first handle disposed on the second end and operatively coupled to the first valve to control the flow rate and the temperature of the water from the inlet to the first outlet of the spout; and a second handle disposed on an outer end of the stem and operatively coupled to the second valve to control the flow rate and the temperature of the water from the inlet to the second outlet of the stem, wherein the each of the first and second handles is operable independently of the other handle.

* * * * *